US009464863B2

(12) United States Patent
Mather et al.

(10) Patent No.: US 9,464,863 B2
(45) Date of Patent: Oct. 11, 2016

(54) ADJUSTABLE BUTTSTOCK FOR FIREARM

(71) Applicant: Sturm, Ruger & Company, Inc., Southport, CT (US)

(72) Inventors: Jonathan Philip Mather, Grafton, NH (US); Adam Jay Taylor, Unity, NH (US); Mark J. Gurney, Sunapee, NH (US)

(73) Assignee: STURM, RUGER & COMPANY, INC.

( * ) Notice: Subject to any disclaimer, the term of this patent is extended or adjusted under 35 U.S.C. 154(b) by 0 days.

(21) Appl. No.: 14/994,394

(22) Filed: Jan. 13, 2016

(65) Prior Publication Data

US 2016/0202016 A1 Jul. 14, 2016

Related U.S. Application Data

(60) Provisional application No. 62/102,830, filed on Jan. 13, 2015.

(51) Int. Cl.
*F41C 23/14* (2006.01)

(52) U.S. Cl.
CPC ..... *F41C 23/14* (2013.01)

(58) Field of Classification Search
CPC ..... F41C 23/00; F41C 23/04–23/14; F41C 23/20; F41A 11/00–11/06
USPC ..... 42/71.01–74, 75.03; 89/158
See application file for complete search history.

(56) References Cited

U.S. PATENT DOCUMENTS 2,405,758 A * 8/1946 Sampson ..... F41C 23/04 42/72
5,519,954 A 5/1996 Garrett
6,442,883 B1 9/2002 Waterman et al.
6,773,172 B1 8/2004 Johnson et al.
7,219,462 B2 5/2007 Finn
7,398,616 B1 7/2008 Weir
7,428,794 B2 * 9/2008 Oz ..... F41A 23/02 42/73

(Continued)

FOREIGN PATENT DOCUMENTS

WO 2014056580 4/2014

OTHER PUBLICATIONS

Mad Duo Nate, "American Defense Manufacturing joins Joint Task Force Awesome", breachbangclear.com, Jul. 25, 2014.

(Continued)

*Primary Examiner* — Stephen M Johnson
*Assistant Examiner* — Benjamin Gomberg
(74) *Attorney, Agent, or Firm* — The Belles Group, P.C.

(57) ABSTRACT

A buttstock includes a mounting extension member attachable to a firearm receiver, an adjustable butt pad for varying the length of the stock, and an adjustable cheek rest for adjusting the height of the stock. The butt pad assembly is attached to the extension member by a laterally compressible clamping member operated by a double-acting cam lever having two locking surfaces and a non-locking release surface. At least one adjustment rail extends forward from the butt pad through opposing movable jaws of the clamping member. The rail can slide forward/rearward to adjust the stock length which is lockable via the cam lever locking surfaces. The cheek rest includes compressible opposing adjustment legs operated by a similarly configured cam lever in one embodiment. The height of the cheek rest may be adjusted and locked in position in a similar manner.

26 Claims, 26 Drawing Sheets

(56) References Cited

U.S. PATENT DOCUMENTS

| | | | | |
|---|---|---|---|---|
| 7,493,721 | B2 | 2/2009 | Swan | |
| 7,562,483 | B2 | 7/2009 | Hines | |
| 7,640,688 | B2 | 1/2010 | Oz | |
| 7,739,824 | B1 | 6/2010 | Swan | |
| 7,757,423 | B1 | 7/2010 | Swan | |
| 7,762,018 | B1 | 7/2010 | Fitzpatrick et al. | |
| 7,802,395 | B1 | 9/2010 | Swan | |
| 7,823,316 | B2 | 11/2010 | Storch et al. | |
| 7,886,476 | B1 | 2/2011 | Swan | |
| 7,984,580 | B1 | 7/2011 | Giauque et al. | |
| 8,061,072 | B1 | 11/2011 | Crose | |
| D654,552 | S | 2/2012 | Wu et al. | |
| D659,221 | S | 5/2012 | Wu et al. | |
| 8,166,691 | B1 | 5/2012 | Karfiol | |
| D663,006 | S | 7/2012 | Storch | |
| 8,336,247 | B2 | 12/2012 | Haering | |
| 8,359,780 | B2 | 1/2013 | Peterson et al. | |
| 8,397,421 | B2 | 3/2013 | Ding et al. | |
| 8,429,844 | B2 | 4/2013 | Dextraze et al. | |
| 8,438,965 | B2 | 5/2013 | Collin et al. | |
| 8,484,882 | B2 | 7/2013 | Haley et al. | |
| 8,499,485 | B2 | 8/2013 | Deros | |
| 8,555,541 | B2 | 10/2013 | Ingram | |
| 8,567,105 | B1 | 10/2013 | Bobro | |
| 8,671,610 | B2 | 3/2014 | Kincel | |
| 8,769,859 | B2 | 7/2014 | Li et al. | |
| 8,806,796 | B1 | 8/2014 | Clifton | |
| 8,813,412 | B2 | 8/2014 | Rorick | |
| 9,097,490 | B2 * | 8/2015 | Tseng | F41C 23/04 |
| 9,360,272 | B2 * | 6/2016 | Hopkins | F41C 23/14 |
| 2012/0137562 | A1 | 6/2012 | Langevin et al. | |
| 2012/0167438 | A1 | 7/2012 | Daniel et al. | |
| 2013/0180148 | A1 | 7/2013 | Rogers et al. | |
| 2014/0075815 | A1 * | 3/2014 | Jarboe | F41C 23/04 42/73 |
| 2014/0082985 | A1 | 3/2014 | Larue | |
| 2014/0259848 | A1 | 9/2014 | Chvala | |

OTHER PUBLICATIONS

Langley, Jim, "Bicycle Bike Repair Fix a Flat Punctured Tire, Fixing Flats Is Fun", http://www.jimlangley.net/wrench/flattire.html#qr2, 2014.

Andersen, John, "Bicycling Life, How to use a Quick Release", http://www.bicyclinglife.com/HowTo/UseAQuickRelease.htm, 1998, Bicycling Life Website.

Lagarde, Larry, "InterBike 2008—SafeTband", http://ridethisbike.com/2008_09_01_archive.html, Sep. 30, 2008 RideTHISbike.com, Cycling for fun, fitness & practicality, New Orleans, LA, 2005-2012.

Corresponding International Search Report and Written Opinion for PCT/US2016/013170 dated Mar. 11, 2016.

* cited by examiner

ADJUSTABLE BUTTSTOCK FOR FIREARM

CROSS-REFERENCE TO RELATED APPLICATIONS

The present application claims the benefit of priority to U.S. Provisional Application No. 62/102,830 filed Jan. 13, 2015, the entirety of which is incorporated herein by reference.

BACKGROUND

The present invention generally relates to firearms, and more particularly to an adjustable buttstock for a firearm that provides a means of adjusting the length of the buttstock and position of the cheek rest.

There are many types of rifle buttstocks that allow the user to make adjustments to the length of pull and cheek rest height to improve the fit of the rifle to the individual user. Many different methods are used to secure and release the moving pieces. Some stocks require the loosening and tightening of nuts and bolts to change positions. This can create a very solid stock with a high amount of adjustability, but making adjustments in the field can be difficult and time consuming.

Other stocks use a threaded jackscrew type mechanism, to raise and lower the cheek rest, or move the butt stock length. These require no tools and can be moved in small increments, but can be time consuming to make large adjustments, and usually allow a small amount of movement between the parts.

Another method uses a notched adjustment rod in combination with a spring loaded locking button. Pressing the button releases the notched rod, allowing the butt pad, or cheek rest, to be moved to a different position, where the spring loaded button will re-engage the notch. These adjustments are easy to make, but also allow a small amount of movement between parts.

Some stocks just use thumb nuts or bolts to clamp the cheek rest at a given position. These are inexpensive and easy to operate, but are also prone to loosening and moving out of position. Several stocks use cam levers to retain a position, but they may still require tools, or multi-handed adjustment methods to properly set the cam tension.

An improved adjustable stock design is desired.

SUMMARY

The present disclosure provides an adjustable rifle buttstock that uses spring-biased cam levers to lock the moving parts into position. The buttstock includes length adjustment features and cheek rest adjustment features allowing a user to customize the buttstock for comfort and fit to accommodate different physiques and preferences.

The cam levers described herein are more rigid and less likely to unintentionally move from the set position either due to vibrations generated by discharging the firearm or by accidental contact by the user or other object. In one embodiment, double-acting cam levers and tool free adjustment methods are disclosed that make the cam locks easier to operate by the user with a single hand and permits two different locking positions of the cam operating handle which accommodates both short or long stock configurations without interference from the handle.

The adjustable buttstock according to the present disclosure uses individual cam levers to release and lock both the length of pull adjustment (i.e. length of buttstock) and the cheek rest height. Advantageously, the double-acting cam levers described herein have the benefit of being able to secure a moving part as tight as a wrench installed fastener, but with the ability of being able to adjust it without tools. There are several features that make the cam levers used on the present buttstock different from the stocks described above.

First, the cam levers are double acting, meaning they provide no camming action in their center position, but provide equal displacement when pushed in either direction. This beneficially allows the user to locate each of the two cam levers in one of two possible closed locked positions to suit both individual preferences and avoid interference with the other cam lever depending on the locked positions selected.

Second, another critical difference with the two double-acting locking cams presented herein is the method used for adjustment. Like any cam with a relatively hard stop, if the length of the cam rod is not set precisely, the cam will either remain loose when closed, or be too tight to require excessive force to move it into the closed position. By contrast in the present invention, easy tool-free adjustment is enabled through the combination of the spring loaded cam levers, and unique finger nut and ribbed washer as further described herein.

According to one aspect, an adjustable buttstock for a firearm includes: a longitudinal axis; an elongated stock mounting extension member configured to mount to the firearm; a clamping member disposed on the mounting extension member, the clamping member having downwardly extending and opposing first and second jaws; a butt pad assembly comprising an elongated butt pad and a first adjustment rail protruding axially forward from the butt pad, the first adjustment rail received between the jaws and slidable between a plurality of indexed axial positions for adjusting the length of the buttstock; the jaws of the clamping member laterally movable together and apart between a locked position lockingly engaging the first adjustment rail in one of the axial positions and an unlocked position partially disengaging the first adjustment rail which allows the rail to slide axially relative to the jaws between the axial positions; an opening spring biasing the jaws apart; a double-acting cam lever assembly mechanically coupled to the first and second jaws, the cam lever assembly comprising a cam lever pivotably mounted on the first jaw and including two opposing locking surfaces selectively rotatable into engagement with a bearing surface on the first jaw and a non-locking release surface disposed therebetween; the cam lever pivotably movable from a center release position to one of two diametrically opposite locking positions; wherein placing the cam lever in the center release position positions the release surface towards the bearing surface on the first jaw and moves the jaws apart to the unlocked position for adjusting the length of the buttstock; wherein moving the cam lever from the center release position to either of the two locking positions engages one of the locking surfaces with the bearing surface on the first jaw and draws the jaws together to the locked position for fixing the length of the buttstock.

According to another aspect, an adjustable buttstock for a firearm includes: a longitudinal axis; an elongated mounting extension member configured to mount to the firearm; a clamping member disposed on the mounting extension member, the clamping member having downwardly extending and opposing first and second jaws; a butt pad assembly comprising a butt pad; an upper adjustment rail protruding axially forward from the butt pad assembly; a lower adjustment rail protruding axially forward from the butt pad assembly; the upper and lower adjustment rails received between the jaws and slidable between a plurality of indexed axial positions for adjusting the length of the buttstock; a plurality of longitudinally spaced apart index grooves disposed on the upper or lower adjustment rail; a double-acting cam lever pivotably mounted on the first jaw, the cam lever comprising an elongated operating handle and an adjoining cam head engaging a bearing surface formed on the first jaw; a coupling shaft extending laterally through the clamping member, the coupling shaft coupled between the cam lever and a movable locking piece of the second jaw, the locking piece including a first locking protrusion selectively engageable with the index grooves; the locking piece laterally movable inwards and outwards with respect to the first jaw between a locked position locking the adjustment rails in one of the axial positions and an unlocked position allowing the adjustment rails to slide axially relative to the jaws between the axial positions; the cam lever pivotably movable from a center release position to one of two opposite locking positions on either side of the center release position;

wherein placing the cam lever in the center release position moves the locking piece outward to the unlocked position in which the first locking protrusion at least partially disengages the index grooves for adjusting the length of the buttstock; and wherein moving the cam lever from the center release position to either of the two side locking positions draws the locking piece inward to the locked position in which the first locking protrusion engages the index grooves for fixing the length of the buttstock.

According to another aspect, an adjustable buttstock for a firearm includes: a longitudinal axis; an elongated mounting extension member configured to mount to the firearm; a clamping member fixedly attached to the mounting extension member, the clamping member having downwardly extending first and second jaws; a butt pad assembly movably coupled to the clamping member, the butt pad assembly comprising parallel longitudinally-extending upper and lower adjustment rails, the upper and lower adjustment rails each received between the jaws and slidable between a plurality of indexed axial positions comprised of longitudinally spaced apart grooves on the adjustment rails for adjusting the length of the buttstock; the second jaw including an upper portion formed integrally with the first jaw and a removable lower locking piece comprising locking protrusions selectively engageable with the grooves of the upper and lower adjustment rails, the locking piece slidable laterally inwards and outwards with respect to the upper portion of the second jaw between a locked position lockingly engaging the adjustment rails in one of the indexed axial positions and an unlocked position partially disengaging the adjustment rails to allow the rails to slide axially relative to the jaws between the axial positions; a double-acting first cam lever mechanically coupled to the first jaw and locking piece of the second jaw, the first cam lever pivotably movable between two opposing locking positions located at least 180 degrees apart and a center release position therebetween, the first cam lever operable to selectively move the locking piece between the unlocked and locked positions by pivoting the cam lever respectively from the release position to either of the locking positions; a cheek rest movably coupled to the upper adjustment rail, the cheek rest adjustable in height with respect to the mounting extension member, the cheek rest including first and second adjustment legs extending downwards from opposing lateral sides of an arcuately curved top of the cheek rest; the first adjustment leg including a pair of vertically extending toothed racks; a first toothed washer comprising dual linear arrays of teeth engageable with the toothed racks on the first adjustment leg; a first spring biasing the first toothed washer outwards for disengaging the toothed racks on the first adjustment leg from the arrays of teeth on the first washer; a double-acting second cam lever mechanically coupled to the first and second adjustment legs, the second cam lever pivotably movable between two opposing locking positions located at least 180 degrees apart and a center release position therebetween; the second cam lever operable to selectively move the cheek rest between (i) a locked position in which the linear arrays of teeth on the first toothed washer engages the toothed racks on the first adjustment leg to lock the cheek rest in position, and (ii) an unlocked position in which the linear arrays of teeth on the first toothed washer at least partially disengage the toothed racks on the first adjustment leg to allow sliding adjustment of the height of the cheek rest.

Further areas of applicability of the present invention will become apparent from the detailed description provided hereinafter.

BRIEF DESCRIPTION OF THE DRAWINGS

The features of the exemplary embodiments will be described with reference to the following drawings where like elements are labeled similarly, and in which:

All drawings are schematic and not necessarily to scale. Parts given a reference numerical designation in one figure may be considered to be the same parts where they appear in other figures without a numerical designation for brevity unless specifically labeled with a different part number and/or described herein. Parts described herein with respect to certain figures may also appear in other figures in which they may be numbered or unnumbered unless otherwise noted herein. Furthermore, a general reference to a whole figure number (e.g. FIG. 6) which may include multiple alphabetic subparts (e.g. FIGS. 6A, 6B, etc.) shall be construed as a reference to all of the subparts unless specifically noted otherwise.

DETAILED DESCRIPTION

Figure 1:
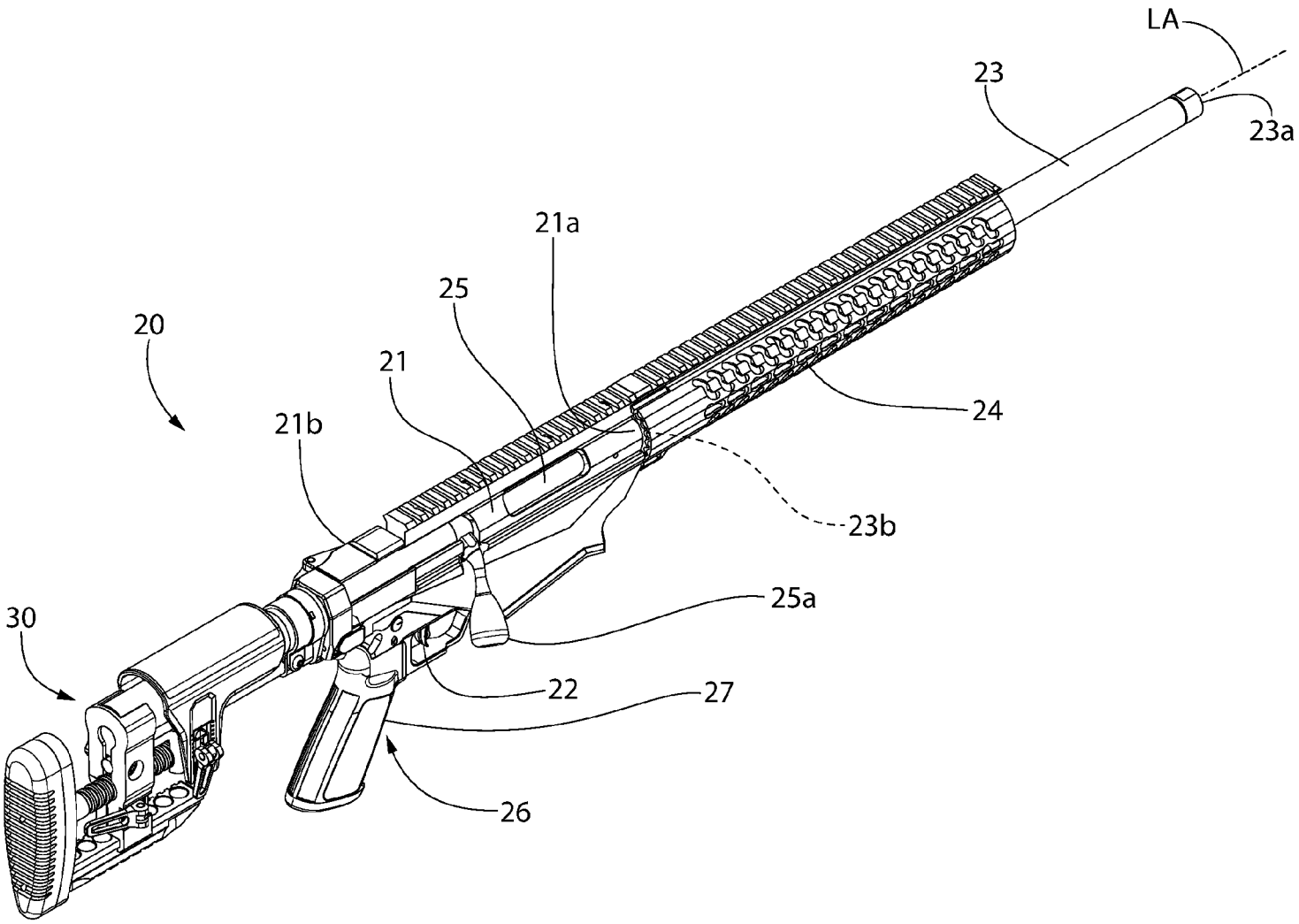
FIG. 1 is a longitudinal perspective view of one embodiment of a firearm including an adjustable buttstock according to the present disclosure.
Figure 2:
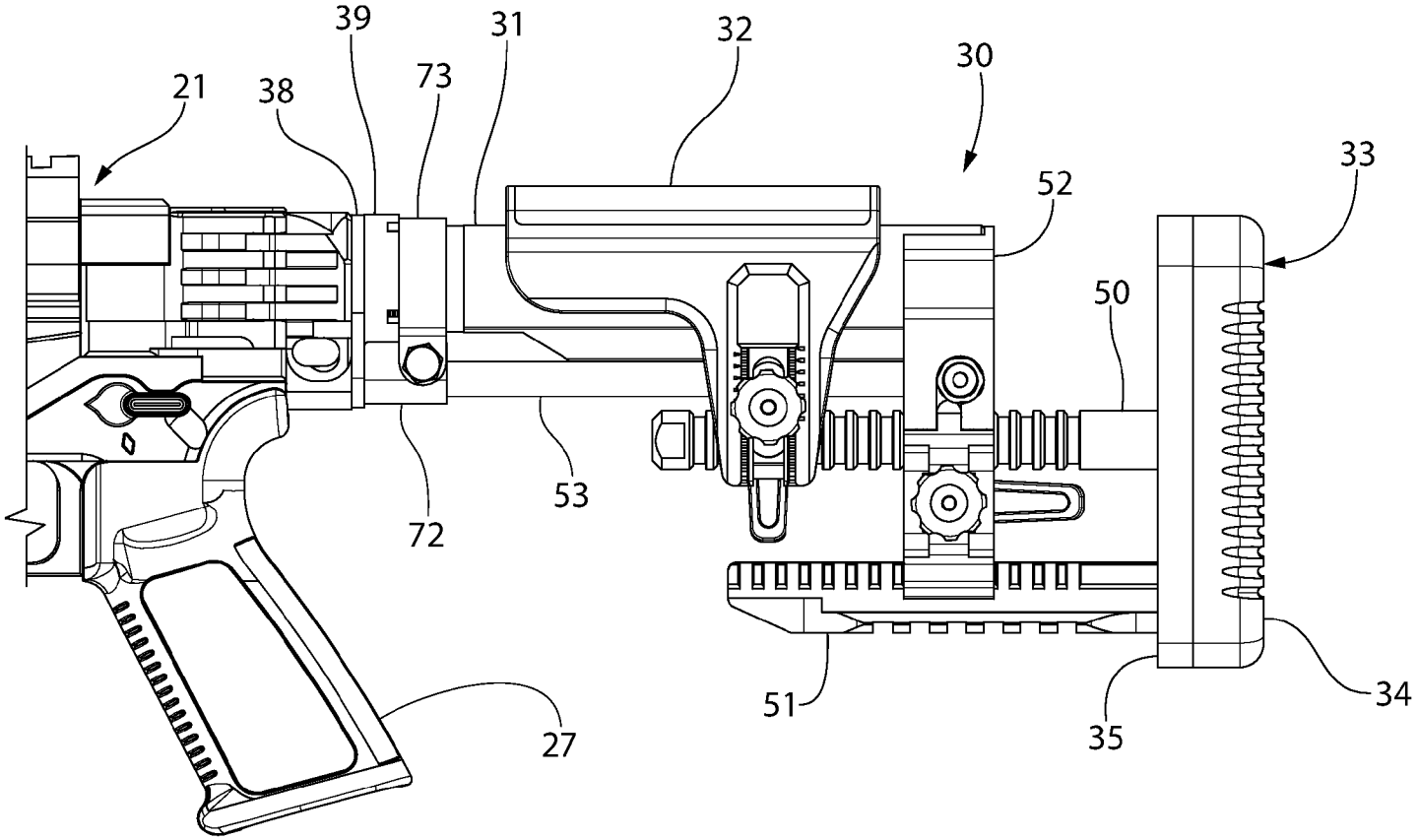
FIG. 2 is a partial left side view of the buttstock.
Figure 3:
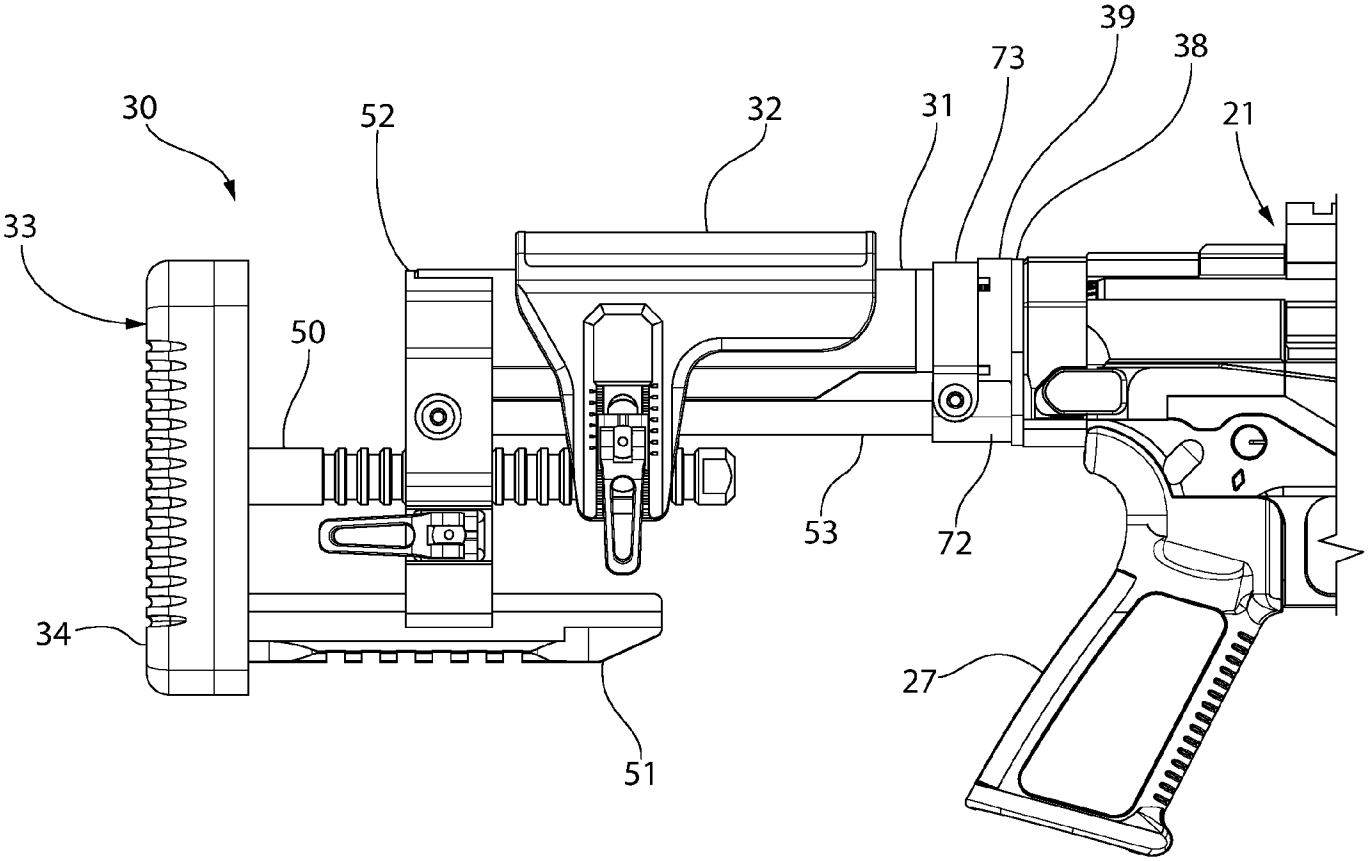
FIG. 3 is a partial right side view of the buttstock.
Figure 4:
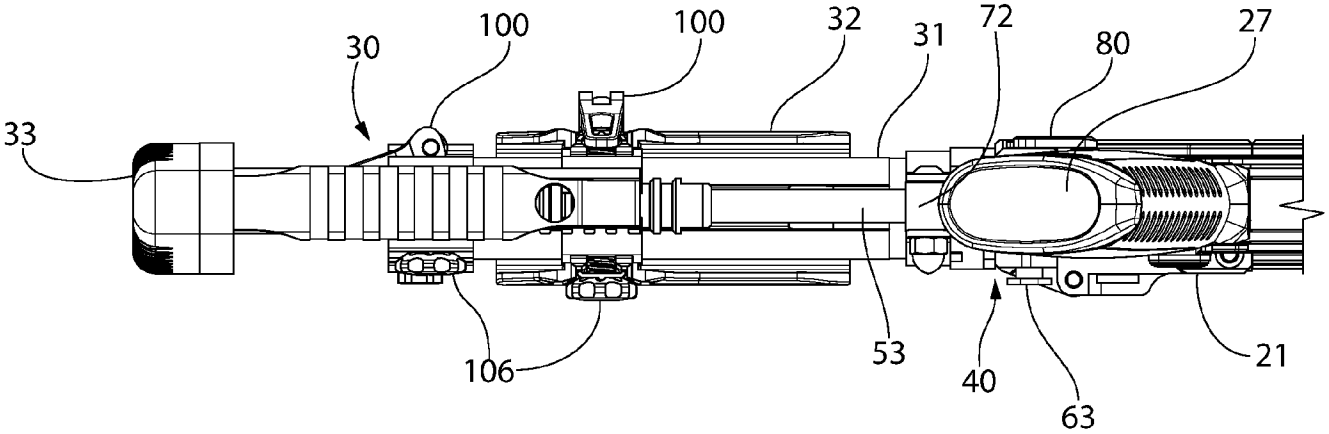
FIG. 4 is a bottom view thereof.
Figure 5:
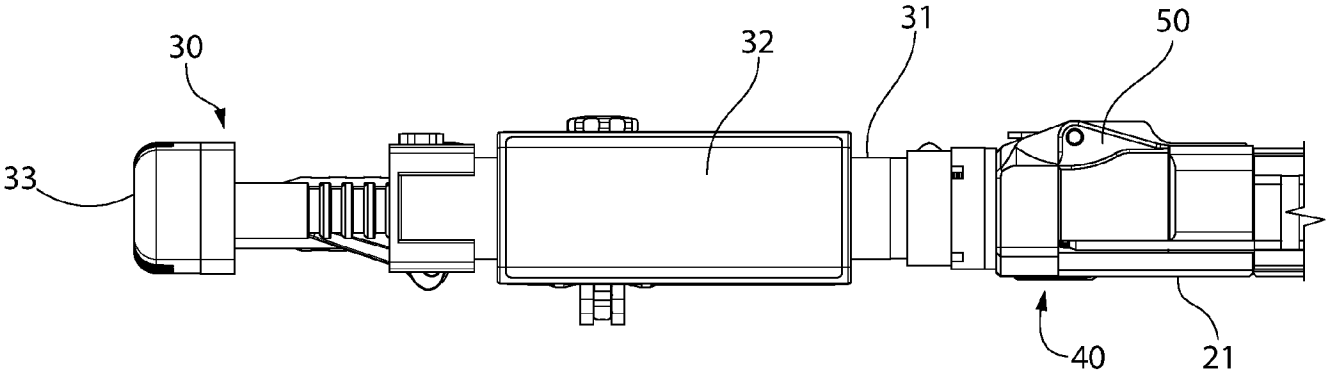
FIG. 5 is a top view thereof.
Figure 6A:
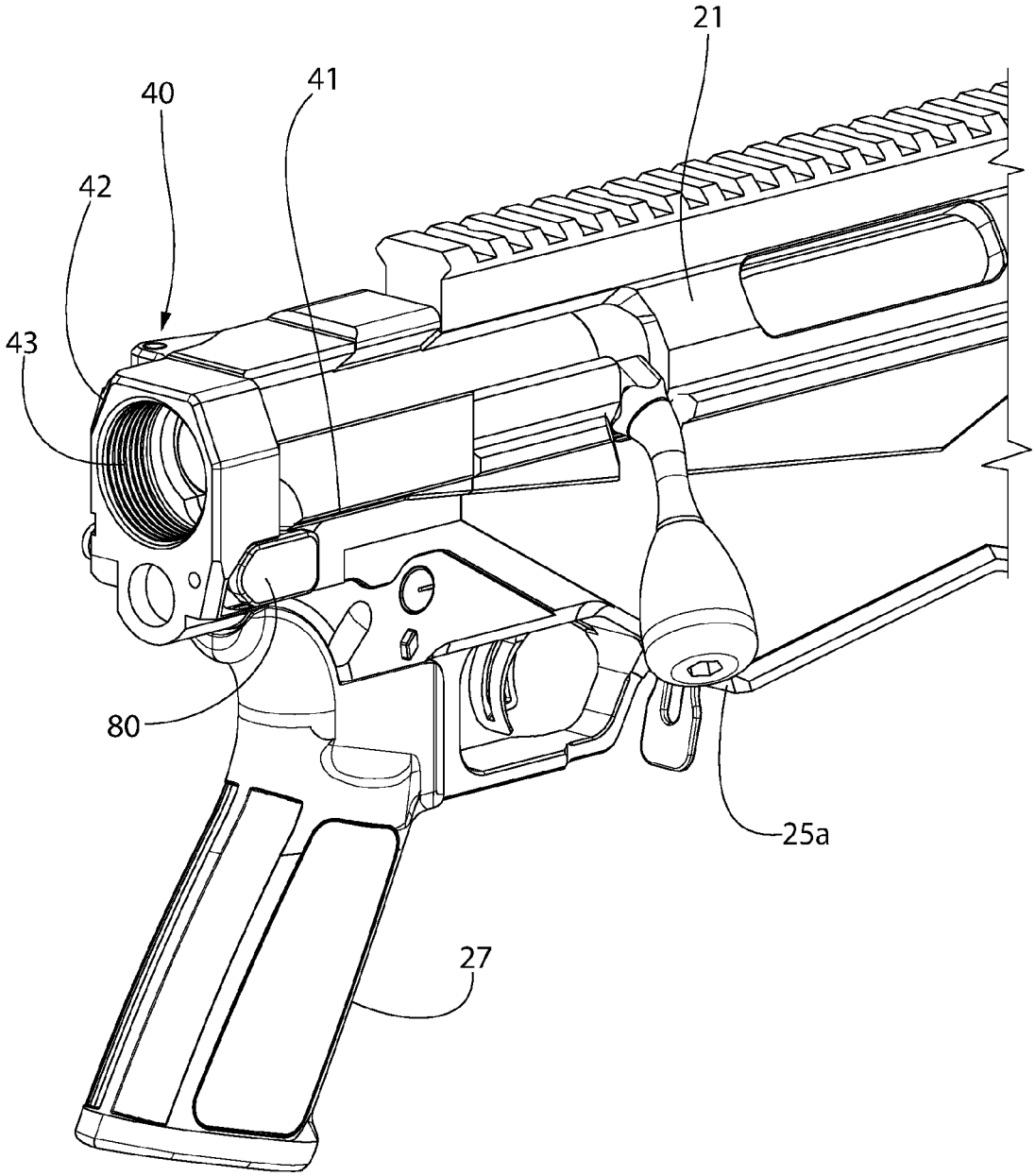
FIG. 6A is a right side perspective view of the firearm without buttstock attached and showing mounting provisions on the rear of the receiver.
Figure 6B:
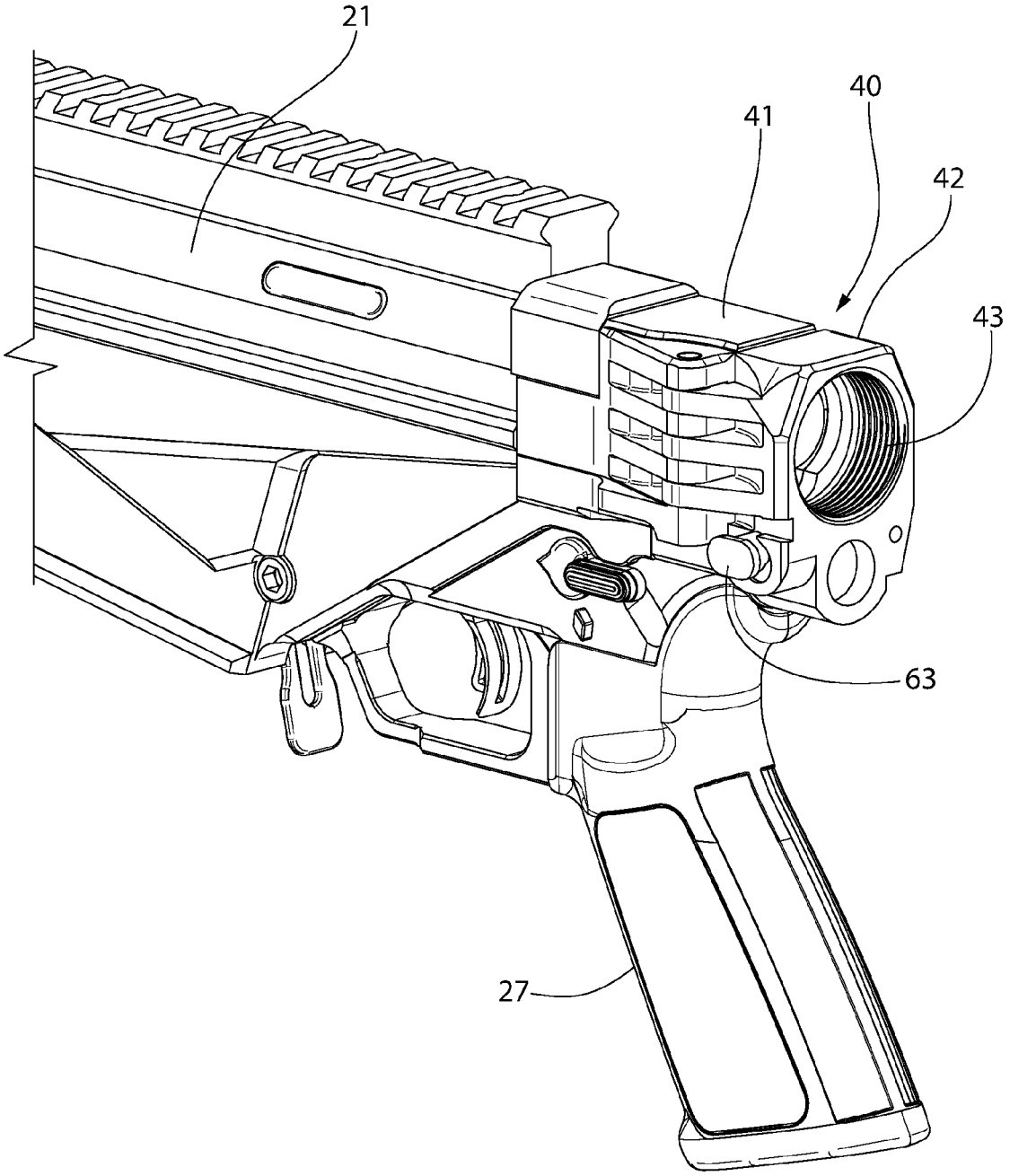
FIG. 6B is a left side perspective view thereof.

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

The term "action" which may be mentioned is used herein in its conventional sense in the firearm art as meaning the mechanism that loads and ejects shells into/from the firearm and opens and closes the breech (i.e. the area in the receiver between an openable/closeable breech face on the front of the bolt and the rear face of the barrel chamber).

Referring initially to FIGS. 1-7, a firearm 20 in the form of a rifle is shown including an adjustable buttstock 30 according to the present disclosure. Firearm 20 may be any type of long gun, including without limitation a rifle or a shotgun. In one non-limiting example illustrated, the firearm 20 may be a bolt action rifle.

Firearm 20 generally includes a receiver 21, a trigger actuated fire control assembly 22 mounted in the receiver and operable to discharge the firearm, a barrel 23 supported by the receiver, optionally a handguard 24 enclosing and circumscribing at least part of the length of the barrel, and buttstock 30. The barrel includes an open front muzzle end 23*a* and an open rear breech end 23*b* (obscured beneath the handguard) coupled to a front end 21*a* of the receiver 21 in any suitable manner. Handguard 24 may similarly be coupled to a front end of the receiver.

The receiver 21 may support other appurtenances including for example a lower stock 26 including a pistol grip 27 disposed at the bottom rear end 21*b* of the receiver and an axially movable bolt 25 which may include a bolt handle 25*a* for forming a closed or open breech. The bolt 25 is slidably moveable forward/rearward in an axially extending internal cavity of receiver 21 and includes a firing pin (not shown) for detonating a chambered cartridge in the rear breech end 23*b* of the barrel 23 that defines the chamber, all of which is well understood by those skilled in the art without further elaboration.

The firearm 20 defines a longitudinal axis LA and axial direction coinciding with the centerline of the barrel 23 and its longitudinal bore formed therein between the muzzle and breech ends 23*a*, 23*b* (not shown) that defines a projectile pathway in a known manner.

The adjustable buttstock 30 extends rearward from the receiver 21 for placement against the user's shoulder when aiming the firearm held in a ready-to-fire position to acquire a target. Buttstock 30 may be any type or configuration of buttstock including adjustable and non-adjustable varieties. The invention is not limited to the type of buttstock which may be used.

An elongated stock mounting extension member 31 of hollow, partially hollow, or solid construction is provided with the buttstock 30 or alternatively the receiver 21 for coupling the buttstock to the receiver. The mounting extension member of any of the foregoing constructions may have any cross sectional shape including without limitation circular, rectilinear, or polygonal. Buttstock 30 in one non-limiting example may incorporate a standard AR-15 rifle style elongated cylindrical mounting tube such as buffer tube 31 (mounting extension member) for coupling the buttstock to the rear end 21*b* of the receiver 21. The buffer tube 31 is coaxially aligned with the longitudinal axis (and barrel 23) which linearly extends from the muzzle end of the barrel to the end of the buttstock. For an AR-15 style rifle, the buffer tube 31 houses the recoil spring and buffer (i.e. weight) of the firing/recoil mechanism inside which is actuated by firing the rifle in a manner well known in the art without further elaboration. However, it should be noted that an AR-15 style buttstock with buffer tube mounting system may nonetheless still be used in other type rifles such as a manually operated bolt action rifle illustrated herein. Such rifles may not need and utilize the added length of a buffer tube for the recoil spring which is omitted because the bolt is withdrawn after firing manually (see, e.g. cross-sectional arrangement in FIG. 18). Accordingly, the present adjustable buttstock mounting system is expressly not limited in its applicability and use to AR-15 style rifles and firing mechanisms alone, but adaptable to numerous different rifle firing mechanism platforms which may take advantage of and utilize the present adjustable buttstock.

Buffer tube 31 has an externally threaded front end 37 which is threadably attached to a rearwardly open threaded socket 43 disposed on the rear end 21*b* of the receiver 21 (see, e.g. FIGS. 6A-B, 8, and 18). Prior to coupling the buffer tube 31 to the receiver, an internally threaded castellated stock lock ring 39 (castle nut) is first threaded onto the front of the buffer tube followed by a stock latch plate 38 which is then slipped over the tube. Buffer tube 31 is then screwed into the socket 43. The stock lock ring 39 is threadably rotated and advanced forward which compresses the latch plate 38 against and locks the buffer tube 31 to the rear end 21*b* of the receiver in a stable manner.

In one non-limiting embodiment, as illustrated, the buttstock 30 may be a folding type buttstock movable between an inline position aligned with the barrel 23 and a laterally offset position folded forward. Accordingly, the rear end of the receiver 21 may include a hinge assembly 40 which comprises a fixed front hinge element 41 attached to the receiver and a rear hinge element 42 pivotably movably in relation to the front hinge element. In this arrangement, the threaded socket 43 to which the buffer tube 31 is mounted may be formed in the rear hinge element 42. In other embodiments without a hinge assembly, the threaded socket may simply be disposed in the rear end of the receiver itself.

Figure 8:
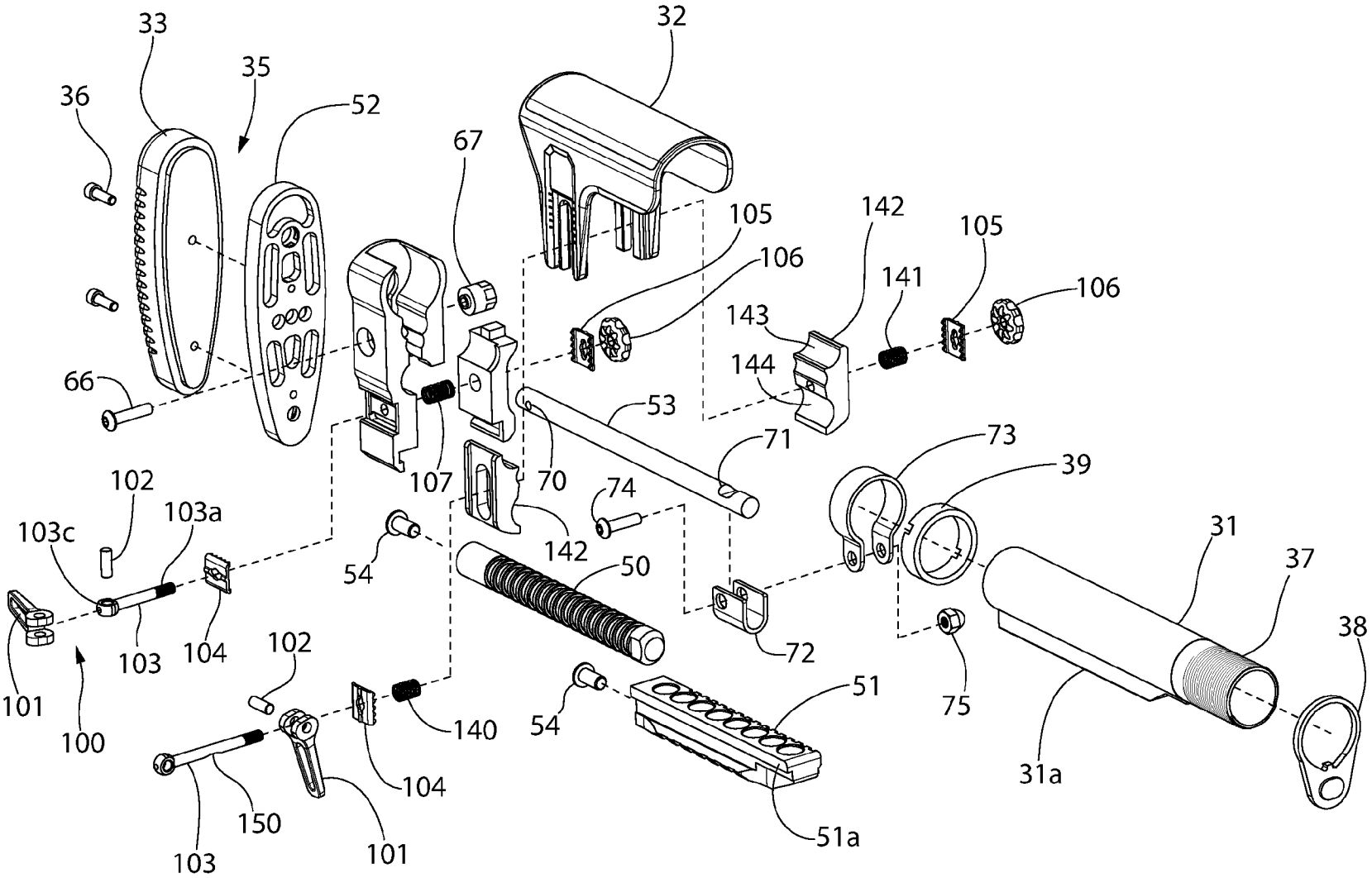
FIG. 8 is an exploded perspective view of the buttstock assembly.

The components of the buttstock 30 are shown in the exploded view of FIG. 8. Buttstock 30 in one implementation may include a vertically adjustable cheek rest 32 and/or a horizontally/axially adjustable butt pad assembly 33 allowing the length of the buttstock to be adjusted to accommodate different users and preferences. In a preferred but non-limiting embodiment, the buttstock includes both an adjustable cheek rest and butt pad assembly; however, other embodiments may include one or the other.

Referring now to FIGS. 1-8, butt pad assembly 33 includes a vertically elongated butt pad 34 and recoil plate 35 attached to the front of the butt pad. Recoil plate 35 may be attached to butt pad 34 by any suitable method, including without limitation threaded fasteners 36 as shown and/or adhesives, friction or interference fit, interlocking features, etc. The recoil plate 35 may be substantially rigid in structure to absorb recoil forces generated by firing the firearm 20, which are transmitted through the buttstock 30 to the butt pad assembly 33. Recoil plate 35 may be made of metal or a non-metallic material such as a hard plastic to reduce weight. The butt pad 34 preferably is made of a deformable cushioned energy absorbing material such as without limitation an elastomeric polymer, rubber, closed or open cell foam, gel, or combinations of these material and others. Butt pad 34 in other embodiments may be made of a substantially rigid material such as plastic or other. Accordingly, the invention is not limited by the construction of the butt pad or recoil plate.

It should be noted that various parts of the buttstock assembly described herein may be made of any variety of suitable materials including glass reinforced or non-reinforced polymers, metals, composite materials, fiberglass, wood, and combinations thereof as some non-limiting examples. The material selection will be dictated in part by functional and service conditions as well as weight saving considerations. Accordingly, the invention is not limited by material selection for the butt pad components.

The adjustment and locking features of the adjustable butt pad assembly 33 will now be described with initial reference to FIGS. 2-5, 7, 8, and 10A-E. Butt pad assembly 33 further includes a locking mechanism generally comprised of an upper adjustment rail 50, lower adjustment rail 51, and clamping member 52. Upper and lower adjustment rails 50, 51 extend longitudinally and axially forward from the butt pad assembly 33 (i.e. parallel to longitudinal axis LA). Rails 50, 51 are rigidly and fixedly attached mounted to the recoil plate 35 in one embodiment which prevents relative movement of the rails with respect to the butt pad assembly. The rails, recoil plate 35, and butt pad 34 provided a separate structurally self-supporting assembly which is coupled to the buffer tube 31 via clamping member 52. Any suitable means or combination of means may be used to secure the rails 50, 51 to the recoil plate 35, including without limitation threaded or non-threaded fasteners, pins, adhesives, welding, interference fits, interlocking features, etc. In one embodiment, threaded fasteners 54 may be used which extend through the recoil plate and engage threaded bores formed in the rear ends of the rails 50, 51 (see, e.g. FIG. 9).

The adjustment rails 50, 51 are may be spaced vertically apart and arranged parallel to each other. The dual rail system providing two points of support for the butt pad assembly helps resist twisting of the buttstock with respect to the receiver and firearm. The rails 50, 51 may lie in the same vertical plane which includes the longitudinal axis LA. Accordingly, in this non-limiting arrangement, the rails 50, 51 are vertically aligned with the longitudinal axis or centerline of the firearm 20 and disposed midway between the lateral sides of butt pad assembly. The upper adjustment rail 50 may be centered on the butt pad assembly and positioned midway between the top heel and bottom toe of the butt pad 34. Accordingly, upper adjustment rail is aligned parallel to longitudinal axis LA but spaced below the axis. The lower adjustment rail 51 is disposed proximate the bottom toe of the butt pad 34.

The upper adjustment rail 50 and lower adjustment rail 51 may have any suitable transverse cross-sectional shape. In the non-limiting embodiment illustrated, the adjustment rails 50, 51 may have different shapes such as the upper adjustment rail 50 may have a circular or round cross-sectional shape and the lower adjustment rail 51 may have a rectilinear cross-sectional shape. In the illustrated configuration, lower adjustment rail 51 may have a T-shaped cross section with top laterally extending opposing flanges 51*a*. It should be noted that in other embodiments contemplated, the shapes of the upper and lower rails may be reversed. In yet other possible implementations, the upper and lower adjustment rails 50, 51 may have the same shape such as both being circular or rectilinear in cross section. Other cross-sectional shapes and combinations of shapes may be used such as for example without limitation non-rectilinear, regular or irregular polygonal, non-polygonal, non-circular (e.g. ellipsoidal), or combinations thereof.

The upper and lower adjustment rails 50, 51 are slideably received through the clamping member 52 which supports the butt pad assembly 33 via at least the buffer tube 31, as will now be described. With additional reference to FIGS. 17A-C, clamping member 52 may generally be considered U-shaped in one embodiment. The clamping member 52 includes vertically extending and laterally spaced apart left and right jaws 60, 61 between which the rails 50, 51 pass in a longitudinal and axial direction. Clamping member 52 includes a top end 55, bottom end 56, front wall 64, opposing right and left lateral sidewalls 59, 57, and common rear wall 58 extending between and joining the lateral sidewalls together. The lateral sides 57, 59 defined by the jaws extend axially forward from rear wall 58. The left and right jaws 60, 61 extend downwardly from the top 55.

In one embodiment, clamping member 52 may be structured, configured, and formed of an elastically deformable material so that the left and right jaws 60, 61 are resiliently flexible and deflectable in a lateral direction to provide a clamping action on the upper and lower adjustment rails 50, 51. The jaws 60, 61 of the clamping member 52 are laterally movable together and apart with respect to each other between a closed locked position lockingly engaging the adjustment rails 50, 51 in one of a plurality of axial positions, and an open unlocked position partially disengaging the adjustment rails to allow the rails to slide axially relative to the jaws between the axial positions for adjusting the length of the buttstock 30. To enhance the flexibility of the jaws, the rear wall 58 may include an elongated vertical slot 62 which terminates at a point proximate to the top of the rear wall and extends downwards through the open bottom end 56 of the clamping member.

Suitable elastically deformable materials for the clamping member 52 with sufficient structural strength to withstand repeated recoil forces from firing the firearm include without limitation glass reinforced or non-reinforced polymers. The polymers may be injection molded to form the clamping member in one construction. Other elastically deformable non-metallic or light-weight metallic materials (e.g. aluminum) however may be used. The upper and lower adjustment rails 50, 51 may be made of similar non-metallic materials or light-weight metallic materials in some embodiments.

The clamping member 52 is attached to the rear end of the buffer tube 31 which provides primary support of the butt pad assembly 33 from the receiver in a cantilevered manner. Accordingly, clamping member 52 includes a forwardly open socket 63 which receives the rear end of the buffer tube 31 which is axially inserted therein. Socket 63 has a generally circular shape in transverse cross section and front view as further shown in FIGS. 11B and 17C. This complements the circular shape of the rear end of the buffer tube 31. Standard AR-15 rifle style buffer tubes include a longitudinally extending bottom rail 31*a* having a generally rectilinear cross section. For buttstock mounting systems according to the present disclosure which may utilize an AR-15 style buffer tube for the stock mounting extension member 31, therefore, a forwardly open lower rectilinear-shaped ancillary socket 65 having parallel flat vertical surfaces is provided which is contiguous with upper circular socket 63. The bottom rail 31*a* of the buffer tube is received in the ancillary socket 65 when the rear end of the buffer tube 31 is inserted into the circular socket 63.

The buffer tube 31 is fixedly clamped to the clamping member 52 by a threaded cross bolt 66 which compresses the jaws 60, 61 against the tube (see exploded view FIG. 8 for full view of bolt). Cross bolt 66 extends laterally and transversely through lateral holes in the left and right jaws 60, 61. The head of the bolt 66 may be positioned in the right jaw 61 and threaded end of the bolt extends through and beyond the left jaw 60 which is coupled to a barrel-type or other nut 67. The bolt head and nut may alternatively be reversed in position on the opposite sides of the clamping member 52. The buffer tube 31 is coupled to the clamping member by first inserting the rear end of the tube through the sockets 63, 65, and then tightening the nut 67. This laterally compresses and draws the left and right jaws 60, 61 together, thereby fixedly clamping the clamping member 52 to the buffer tube 31.

In other embodiments contemplated, the stock mounting extension member 31 whether in the form of a buffer tube or another configuration may be formed as an integral unitary structural part of the clamping member 52. Accordingly, the mounting extension member 31 need not necessarily be a separate part coupled to the clamping member as shown herein, but rather is disposed on the clamping member.

In some embodiments, additional secondary support for the butt pad assembly 33 may optionally be provided by an elongated stabilizing rod 53 engaged with and longitudinally extending between the receiver 21 and clamping member 52. Rod 53 may be cylindrical and round in transverse cross section in one embodiment; however, other cross-sectional shapes may be used (e.g. rectilinear, polygonal, etc.). The rear end of stabilizing rod 53 is inserted into a complementary configured front opening or socket 69 in the clamping member. A transverse threaded hole 70 in the rod receives the same cross bolt 66 used to compress the left and right jaws 60, 61 together for clamping the buffer tube 31, as described above. This positively locks the stabilizing rod 53 to clamping member 52 preventing axial pullout of the rod. The rod 53 is further compressively clamped to the clamping member by cross bolt 66 similarly to buffer tube 31 clamping action thereby providing a secondary means for securing the rod.

Figure 7:
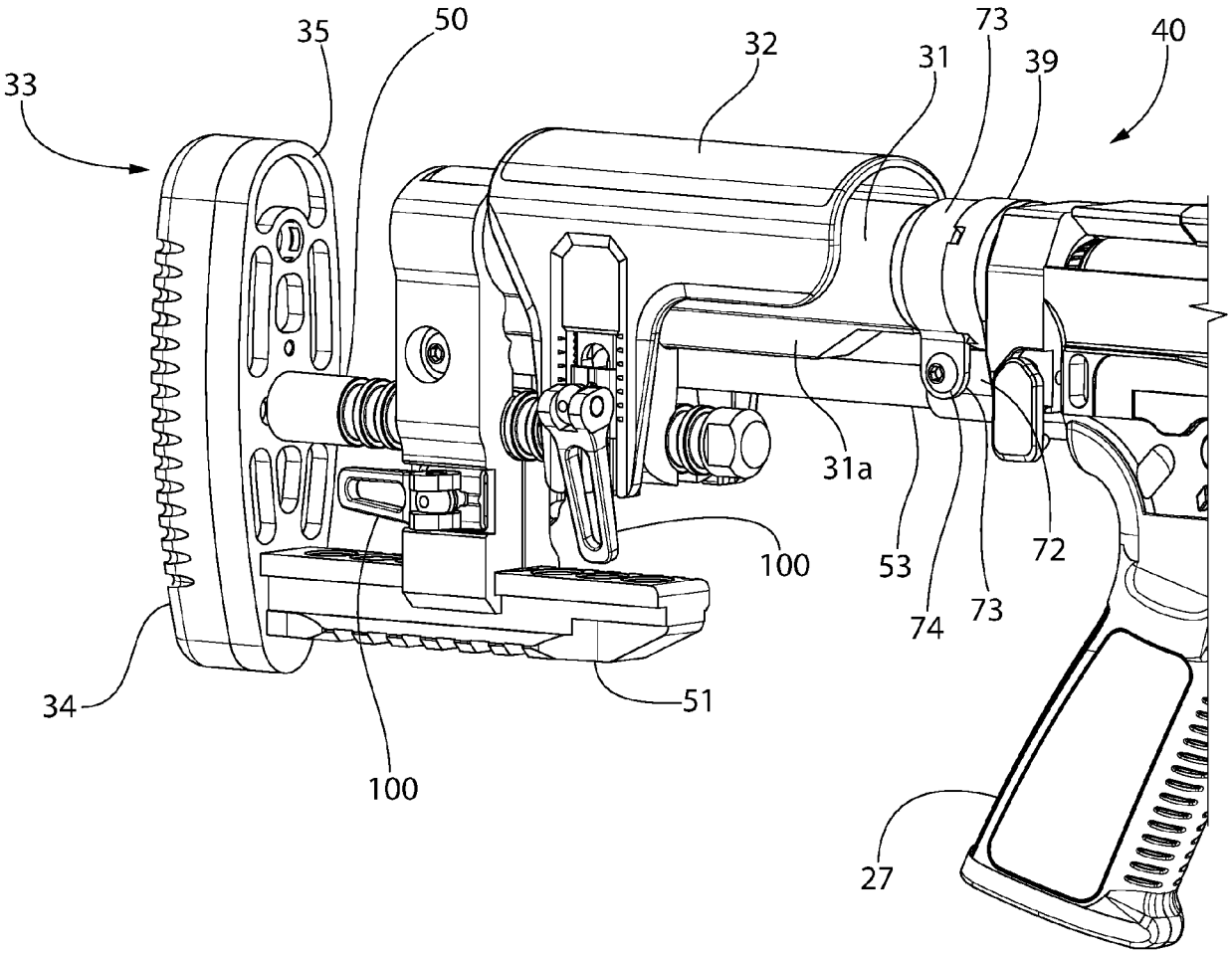
FIG. 7 is right side perspective rear view of the firearm with buttstock.
Figure 18:
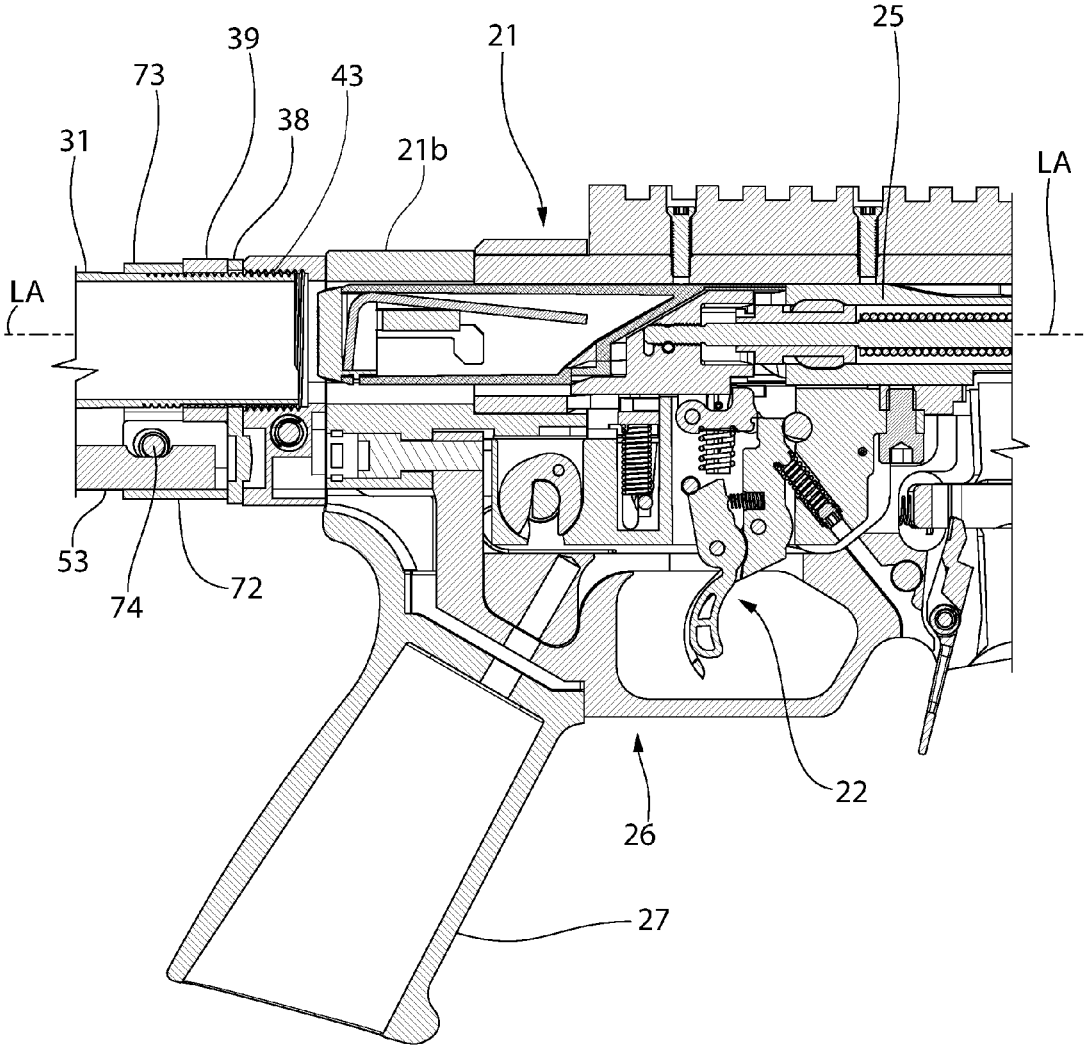
FIG. 18 is a right side cross sectional view of the receiver showing mounting details of the buttstock assembly.

The front end of the stabilizing rod 53 is secured to the mounting assembly used to mount the buffer tube 31 to the receiver 21 as described above. With additional reference to FIG. 18 showing a cross-sectional view of the rear end of the receiver, the front end of rod 53 is inserted into a U-shaped bracket 72 coupled to the buffer tube 31 by a bifurcated compression ring 73. As best shown in FIG. 7, the spaced apart lower ends of the ring 73 are positioned outboard of the spaced apart vertical sides of the bracket 72. The front end of stabilizing rod 53 rests on the inside horizontal bottom portion of the bracket 72 and is axially locked in place by a threaded transverse bolt 74. Bolt 74 extends transversely through a laterally open locking depression 71 formed on top of the rod, a pair of laterally open holes in the bracket 72, and pair of laterally open holes in the compression ring 73. Tightening bolt 74 applies a lateral clamping force by the ring 73 onto the buffer tube 31 which secures the axial position of both the ring and bracket 72 on the buffer tube 31. Once the bolt 74 is inserted through rod 53, ring 73, and bracket 72, the depression 71 acts to axially lock the stabilizing rod 53 to the bracket 72 and buffer tube assembly so that the rod cannot be axially withdrawn rearwards from the bracket due to interference between the bolt 74 and rod.

Buffer tube 31 and stabilizing rod 53 are preferably made of metal such as aluminum, titanium, or steel; however, other suitable materials including non-metallic materials (e.g. glass reinforced nylon, etc.) may be used in some embodiments.

Figure 16A:
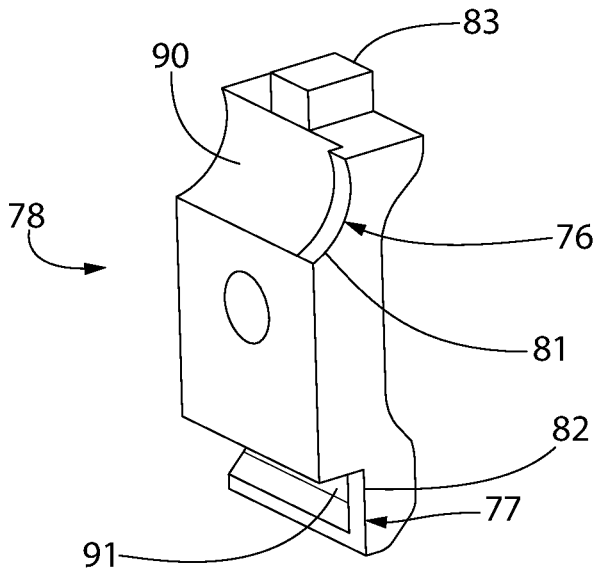
FIGS. 16A and 16B are back (inside) and front (outside) perspective views of a locking piece of the butt pad locking mechanism.

With continuing reference to FIGS. 2-5, 7, 8, and 10A-E, clamping member 52 interfaces with upper and lower adjustment rails 50, 51 to selectively either allow the rails to slide through the clamping member for adjusting the length of the buttstock 30 or to lockingly engage the rails once the desired length is set. Accordingly, the clamping member includes locking features mutually configured with the rails 50, 51 to fix the length of the buttstock once adjusted. Clamping member 52 includes an upper locking protrusion 76 and lower locking protrusion 77 (see, e.g. FIG. 16A) arranged to engage the upper adjustment rail 50 and lower adjustment rail 51, respectively.

Figure 16B:
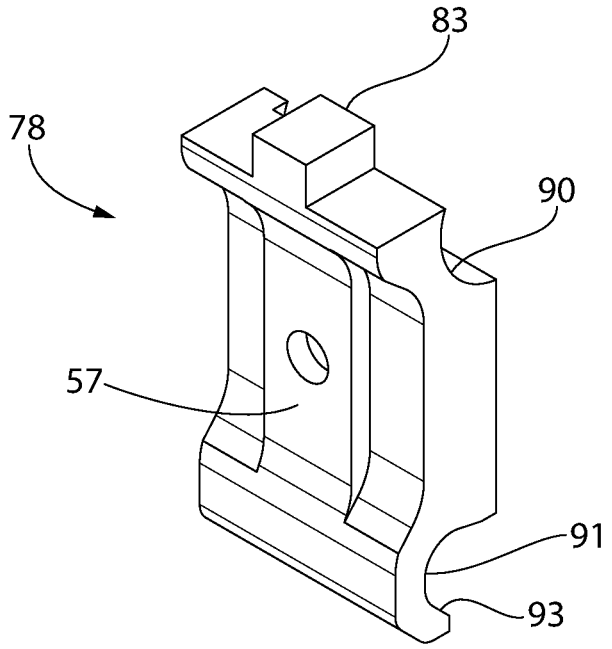
Figure 17B:
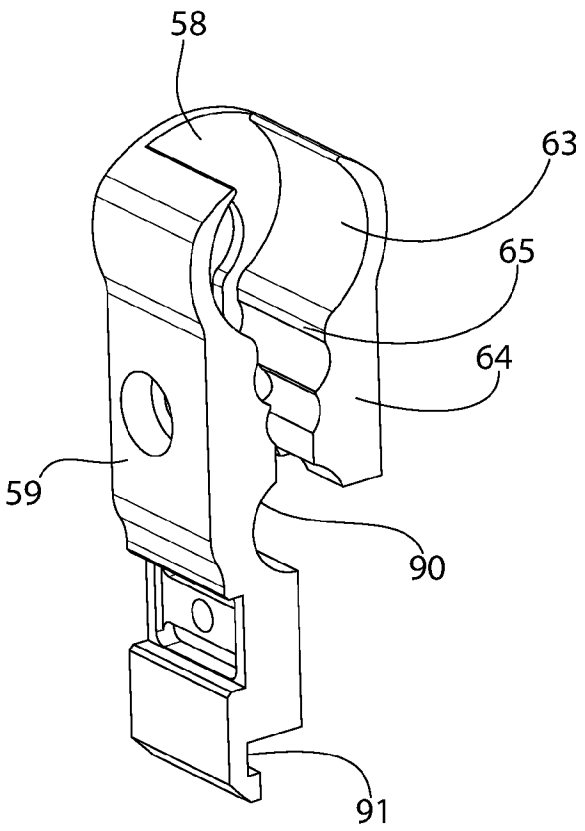
FIGS. 17A-C show a rear perspective view, front perspective view, and front elevation view of the clamping member of the butt pad locking mechanism.
Figure 17A:
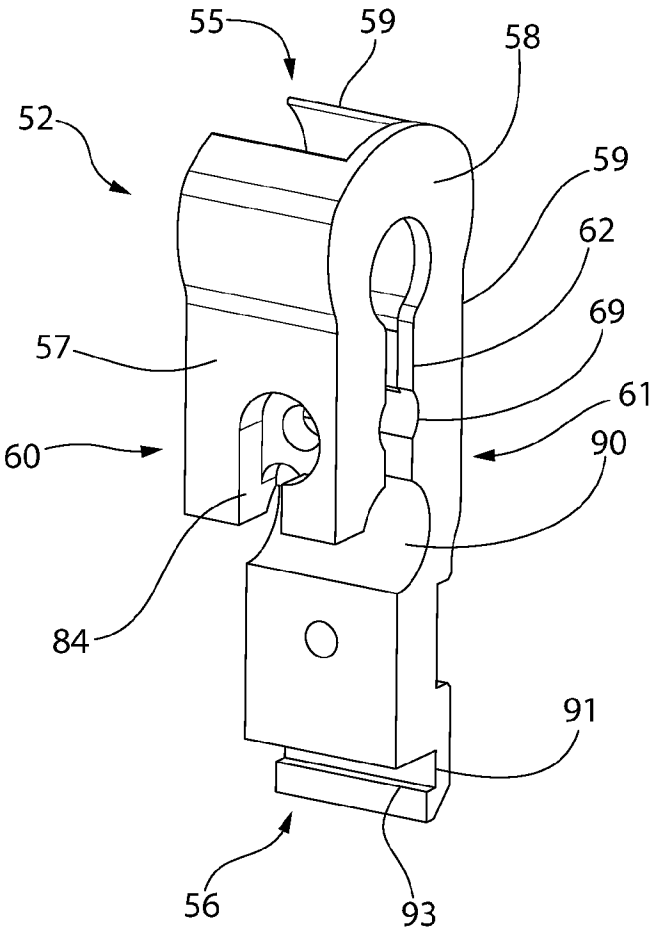
Figure 17C:
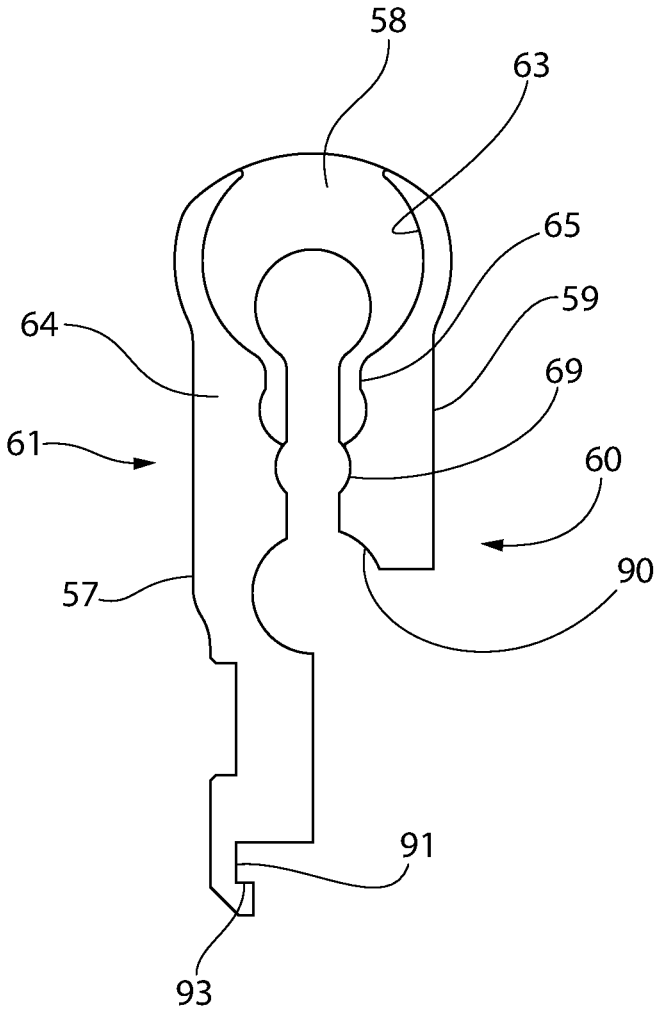

In one non-limiting embodiment, the lower portion of the left jaw 60 is detachable and forms a locking piece 78 configured to lockingly engage the upper and lower adjustment rails 50, 51. The upper and lower locking protrusions 76, 77 of the clamping member 52 may therefore be formed on this separate removable locking piece 78 (best shown separately in FIGS. 12B and 16A-B). Locking piece 78 provides the locking and release functions of the clamping member 52 to allow sliding of the rails 50, 51 relative to the clamping member, or to prevent sliding by lockingly engaging the rails. Locking piece 78 forms the lower end of the jaw 60. Referring also to FIGS. 17A-C, the substantially stationary fixed upper portion of the left jaw 60 above locking piece 78 is non-detachable and an integral unitary structural part of the clamping member 52 with the right jaw 61. The clamping member in one embodiment is made from a machined, molded, and/or cast monolithic piece of material (formation method depending on the material used). When the locking piece 78 is in place on the clamping member 52, the right and left jaws have substantially the same configuration particularly with respect to the shape of vertical slot 62 and openings formed therein in front side view for the adjustment rails 50, 51, thereby making the right side shape of the slot a mirror image of the left side shape. The openings or socket for the buffer tube 31 and stabilizing rod 53 may be formed in the non-detachable fixed upper portion of the left jaw 60 and adjoining right jaw 61 of the clamping member 52.

In some embodiments contemplated, it should be noted that a single upper or lower locking protrusion 76, 77 may be used. In this case, only one of the upper or lower adjustment rails 50, 51 may include index grooves 79 or 80 respectively (further described below) to provide the rail locking function. The other rail may be non-indexing and serves to provide additional slidable support for the butt pad assembly 33. In one embodiment, the upper adjustment rail 50 includes index grooves 79 and the lower adjustment rail has no index grooves.

It will be appreciated that in other embodiments contemplated, however, index grooves 79, 80 and locking protrusions 76, 77 may be omitted and clamping pressure alone generated by the clamping member 52 and cam lever assembly 100 may be relied upon to provide the necessary locking force and non-sliding engagement between the upper and lower adjustment rails 50, 51 and clamping member. Accordingly, such a clamping member without locking protrusions may alone produce the locked and unlocked positions of the jaws 60, 61 by direct engagement with or disengagement from the adjustment rails.

In one embodiment, the locking piece 78 may be keyed to the non-detachable fixed upper portion of the left jaw 60 to provide a meshed fit which helps resist relative axial displacement of the locking piece with respect to the upper left jaw portion. This arrangement further allows the locking piece 78 to move laterally with respect to non-detachable fixed upper portion of the left jaw 60 for forming the locked and unlocked positions of the clamping member 52. The top of the locking piece 78 may include an upwardly extending key 83 which engages laterally extending keyway 84 formed on the fixed upper portion of the left jaw 60 (see, e.g. FIGS. 12A-B, 16A-B, and 17A-B). The key is slid laterally inwards into the keyway when assembled. The locking piece 78 is further detachably coupled to the clamping member 52 by the butt pad cam lever assembly 100 which acts to hold the locking piece 78 on the clamping member (albeit movably), as further described herein.

Referring now to FIGS. 12A-B and 16A-B, the locking protrusions 76, 77 of the locking piece 78 may each be in the form of vertically oriented upper and lower teeth 81, 82 disposed on the interior side of locking piece 78. Each tooth 81, 82 protrudes laterally inwards and is arranged to selectively engage one of a plurality of mating vertical index grooves 79 and 80 formed on the upper and lower adjustment rails 50, 51, respectively. Grooves 79, 80 are laterally open and axially spaced apart on the rails to provide a plurality of possible axially indexed positions for adjusting and setting the length of the buttstock 30. In one embodiment, grooves 80 on the lower adjustment rail 51 may be formed in the protruding left side top flange 51*a*.

The locking protrusions 76, 77 preferably have a shape that permits positive locking engagement with the transverse cross-sectional shape of the index grooves 79, 80 based on the cross-sectional shape of the upper and lower adjustment rails 50, 51 provided. In one embodiment, for example, the upper locking protrusion 76 may have a curved shape with an arcuate edge which engages the arcuately shaped grooves 79 of the upper adjustment rail 50. The lower locking protrusion 77 may have a rectilinear shape with a vertical straight edge which engages the vertical grooves 80 of the lower adjustment rail 51. It bears noting that the shape of the locking protrusions 76, 77 is also selected to provide adequate clearance and disengagement of the protrusions from grooves 79, 80 when the clamping member 52 is in the unlocked position. This allows the rails 50, 51 to slide past the locking protrusions for adjusting the length of the buttstock 30. It should be noted that the disengagement need only be sufficient to allow the rails 50, 51 to slide through the clamping member 52 when it is in the unlocked position. Accordingly, complete disengagement is not required, and partial sliding engagement is sufficient which may produce a ratcheting action and familiar "clicking" sound to advise the user how far the buttstock has been extended or retracted. The locking protrusions 76, 77 will partially engage each groove 79, 80 as the protrusions rides over the upper and lower adjustment rails 50, 51 producing the ratcheting sound.

In some embodiments contemplated, it should be noted that a single upper or lower locking protrusion 76, 77 may be used on locking piece 78. In this case, only one of the upper or lower adjustment rails 50, 51 may include index grooves 79 or 80 respectively to provide the rail locking function. The other rail may be non-indexing and serves to provide additional slidable support for the butt pad assembly 33. In one embodiment, the upper adjustment rail 50 includes index grooves 79 and the lower adjustment rail has no index grooves.

In other embodiments contemplated, a single adjustment rail may be provided in lieu of separate upper and lower adjustment rails 50, 51 described above and shown herein. Accordingly, either one of the upper or lower adjustment rails may alone be used having index grooves 79 or 80 attached to butt pad assembly 33 and clamping member 52 at the same or different locations than disclosed herein. In alternative configurations, a single adjustment rail if provided may have a different configuration and size (i.e. cross sectional shape and/or length). Examples include solid or hollow structural shapes such as for example without limitation I-beams, T-beams, channels, angles, or rectilinear box beam shaped members. The axial sockets or holes in the jaws 60, 61 of the clamping member 52 would then be modified to complement the cross sectional shape of the adjustment rail. A single adjustment rail preferably includes index grooves for mating with a single locking protrusion provided with locking piece 78. However, in other less preferably but satisfactory embodiments the index grooves may be omitted and clamping pressure alone may be relied upon to provide the necessary non-sliding engagement capabilities if sufficient clamping force may be generated by the cam lever assembly. Preferably if one adjustment rail is furnished, a non-circular cross sectional is used to avoid twisting of butt pad assembly with respect to the clamping member and firearm which will maintain the upright orientation of the butt pad. If two adjustment rails are provided as disclosed herein, twisting will not occur by virtue of the dual spaced apart connections to the clamping member.

Referring to FIGS. 8, 11B, 12A-B, 16A-B, and 17A-C, the jaws 60, 61 of the clamping member 52 further define longitudinally extending upper and lower channels 90, 91 which are axially elongated. The channels 90, 91 extend completely through the clamping member. Channels 90 and 91 receive the upper and lower adjustment rails 50, 51 slideably therethrough when the clamping member is in the unlocked position. Each channel is configured and dimensioned to conform to and complement the cross-sectional shape of the adjustment rail 50 or 51 received therethrough. In the present embodiment, the upper channel 90 has a circular shape in front/rear view (transverse profile) formed by an arcuately curved surface and the lower channel 91 has a T-shape in front/rear view (transverse profile) formed by a rectilinear surface. The lower adjustment rail 51 in one embodiment extends below the bottom end 56 of the clamping member 52. The upper portion of channel 91 forms an inwardly extending ledge 93 which slideably engages the bottom of the top flanges 51*a* on the lower adjustment rail 51 to vertically hold and support the rail. Accordingly, the lower channel 91 need only be high enough to grip the lower adjustment rail.

In other embodiments contemplated where the clamping member 52 is both structured and formed of a semi-rigid but still sufficiently resilient material to compress and secure the buffer tube 31 to the clamping member, the locking piece 78 with locking protrusions may be formed as a unitary structural part of the left jaw 60 and right jaw 61. In this configuration, the locking piece moves in unison with the upper portion of the left jaw 60 as an integral part of the jaws between the locked and unlocked positions. In such a case, the clamping member 52 may temporarily and partially release tube 31 during buttstock length adjustment.

The lateral clamping action of the clamping member 52 to selectively either lockingly engage or slideably disengage the upper and lower adjustment rails 50, 51 is controlled by a rear double-acting butt pad cam lever assembly 100 in one embodiment. The cam lever assembly 100 is mounted on the clamping member 52 and mechanically couples the left and right jaws 60, 61 together. Actuation of the cam lever assembly 100 operates to move the clamping member between the locked and unlocked positions, as further described herein.

Referring initially to FIGS. 7-12, cam lever assembly 100 generally comprises an elongated cam lever 101, transversely extending coupling shaft 103, washers 104, 105, finger nut 106, and opening spring 107. The washers 104, 105 provide vertically oriented lateral bearing surfaces for the cam lever 101 and finger nut 106 respectively when the cam lever assembly is mounted to the jaws 60, 61. However, it other embodiments, one or both washers may be omitted and outer surfaces of the right and left lateral sidewalls 59, 57 of the clamping member 52 itself may instead form the bearing surfaces. Washers 104, 105 may be any type of washer with a through opening for coupling shaft 103 and includes flat surfaces on the outward facing side. In one embodiment, washers 104, 105 may be rectilinear shaped as shown; however, round or other shaped washers may be substituted. The washers are preferably made of metal, but non-metal durable washers made of other materials such as polymers may be used.

The coupling shaft 103 extends laterally between the left and right jaws 60, 61 of the clamping member 52 to operably couple the jaws together. In one embodiment, the coupling shaft 103 may be in the general form of an eye bolt having a threaded portion 103*a* on one end and a circular opening 103*b* ("eye") at the other enlarged end 103*c*. Other configurations of coupling shafts may be used.

Cam lever 101 is shown and described as mounted on the right jaw 61 of the clamping member 52 in the present example; however, in other embodiments the cam lever may be mounted instead on the left jaw 60 and will function in the same manner. This mounting may be preferable for left-handed firearm users or for right folding stocks.

Cam lever 101 includes an elongated operating handle 108 and a cam head 109 at one end of the handle. Cam head 109 may have an oblong shape and comprises two diametrically opposing arcuate locking surfaces 110*a*, 110*b* and a flat release surface 111 disposed therebetween. The locking surfaces are on the short sides of the cam head. The cam head 109 may be a bifurcated structure forming two spaced apart halves defining a slot 112 therebetween. Slot 112 receives the enlarged end 103*c* of coupling shaft 103 with opening 103*b*. The opening 103*b* is concentrically aligned with holes formed in each half of the cam head 109 which all receive pivot pin 102 therethrough that pivotably couples the coupling shaft and cam lever 101 together. To provide a smooth but tight fit between the coupling shaft 103 and cam head 109, the enlarged end of the coupling shaft may be flattened on each side to mate with corresponding flat interior surfaces of the cam head on each side of the slot 112. This fit allows rotation of the cam lever 101 without excessive play or wobbling which is desirable.

Figure 12A:
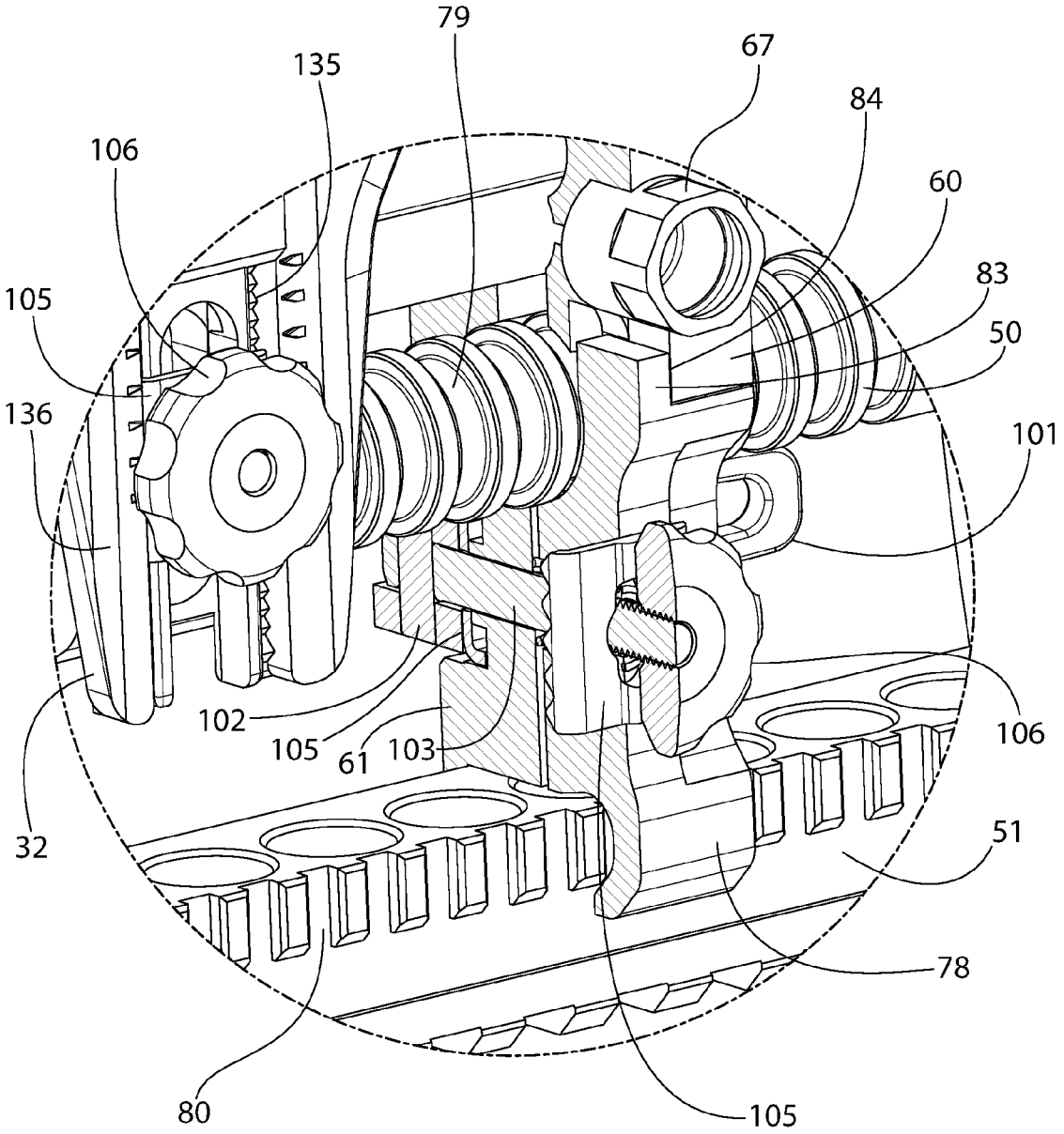
FIG. 12A is a left side partial cross sectional perspective view taken through the cam operated butt pad locking mechanism.
Figure 12B:
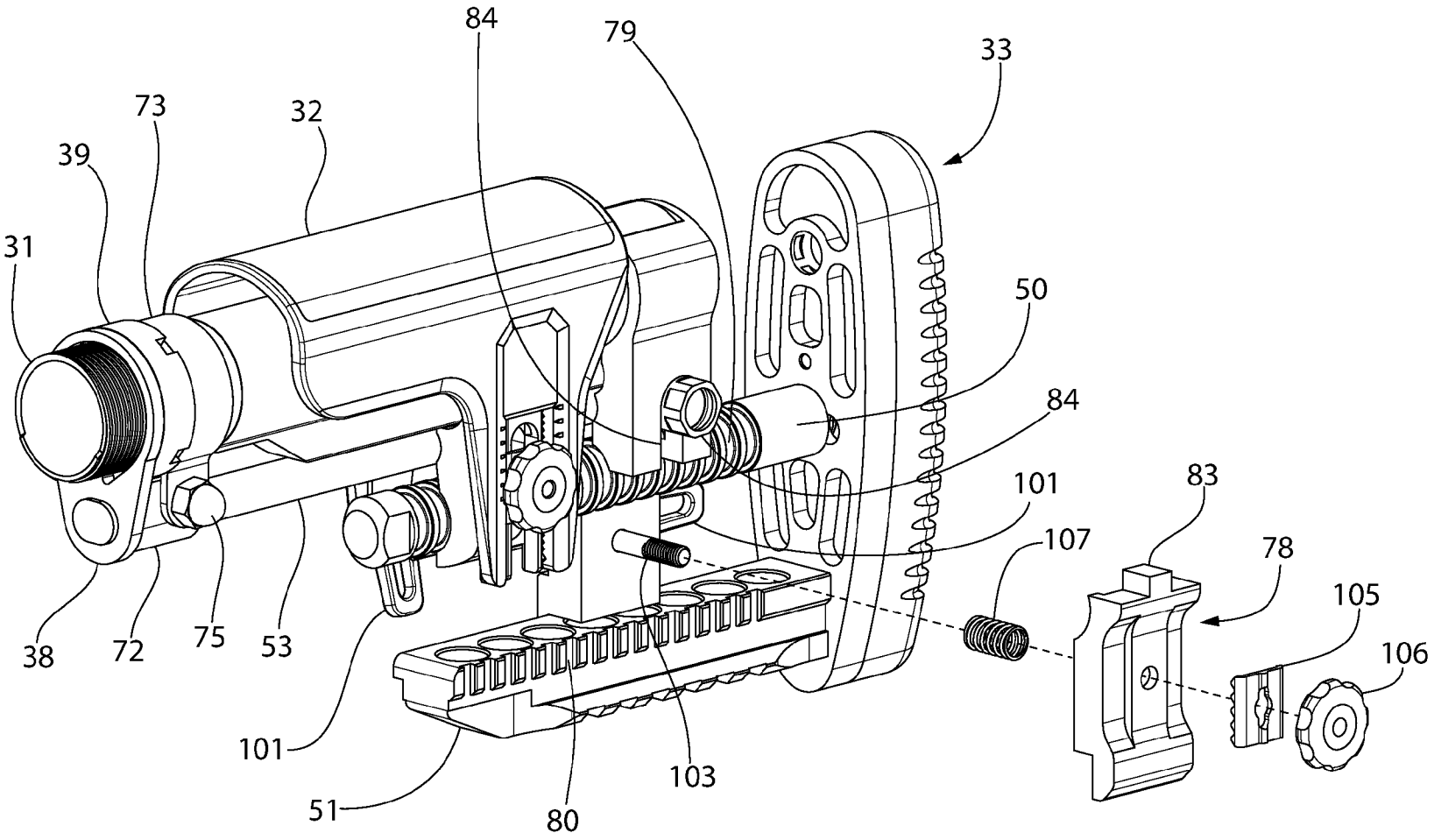
FIG. 12B is an exploded left side perspective view thereof showing components of the locking mechanism.

The coupling shaft 103 extends transversely between the right to left sides of the clamping member 52 from the cam head 109 through washer 104, then through a laterally open hole in the right jaw 61, then through a laterally open hole of locking piece 78 of the left jaw 60 so that the threaded end 103*a* of the shaft protrudes outwards beyond the left sidewall 57 of the clamping member as shown (best shown in FIG. 12B). The threaded end 103*a* of coupling shaft 103 receives in turn washer 105 followed by finger nut 106 each positioned on the outer lateral surface of sidewall 57 of the left jaw locking piece.

Spring 107 may be a helical compression spring; however, other type springs may be used. The spring 107 is positioned over the coupling shaft near threaded end 103*a* on the inside of the locking piece 78. The spring 107 may be seated in an inwardly open interior pocket formed in the locking piece 78 (best shown in FIGS. 9A-B). One end of the spring abuts left jaw locking piece 78 and the other end abuts right jaw 61 of the clamping member 52. The opening spring 107 biases the jaws 60, 61 apart towards the unlocked position which is counteracted by the cam lever assembly 100 that prevents the left jaw locking piece 78 from being ejected. In particular, the keyed arrangement of the locking piece 78 (urged outwards by the spring) to the non-detachable upper portion of the left jaw 60 allows the locking piece 78 to move laterally outward and inward with respect to the upper portion to either lock or release the upper and lower adjustment rails 50, 51. Advantageously, this further allows the clamping member 52 to have a somewhat less flexible but stronger semi-rigid structure than otherwise necessary to perform the clamping action on the upper and lower adjustment rails and is better equipped to withstand the large rearward recoil forces acting on the buttstock which are generated by discharging the firearm 20. It will be appreciated that in other possible embodiments, the locking piece 78 may instead be non-detachable and formed as a unitary structural part of the clamping member 52. This would require a more elastically deformable and flexible structure for the clamping member 52 to allow the jaws 60, 61 to move laterally together or apart sufficiently to form the locked and unlocked positions with respect to the upper and lower adjustment rails 50, 51.

Figure 9A:
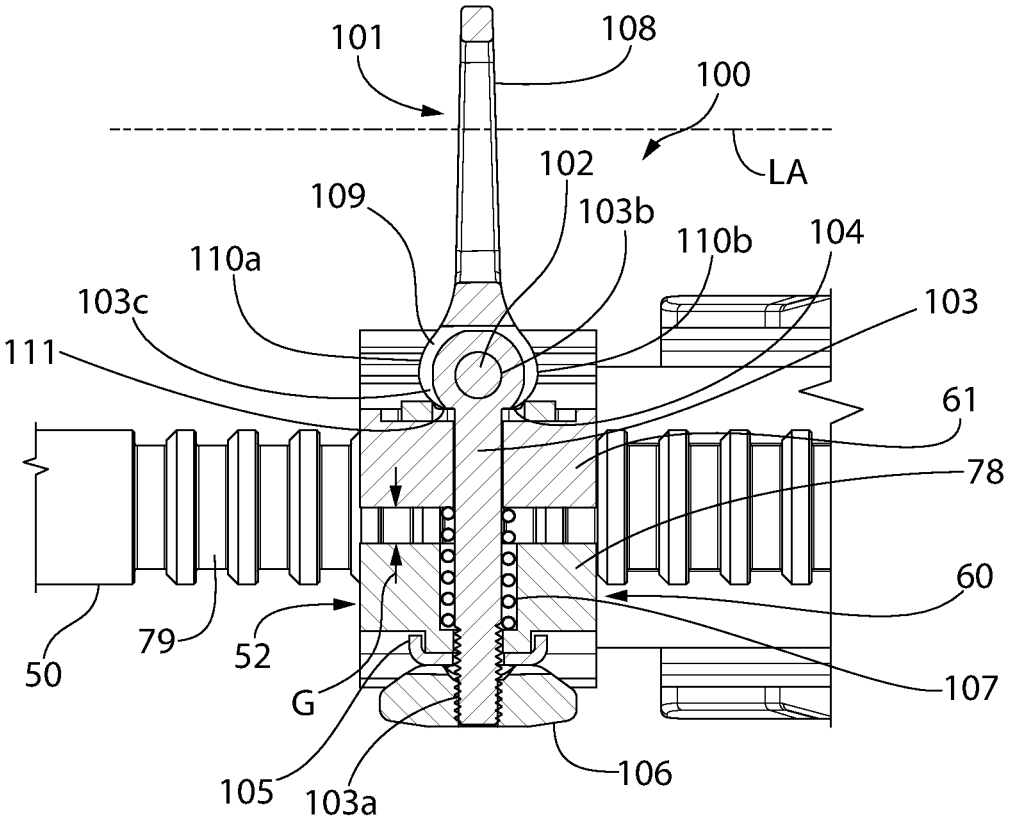
FIG. 9A is a cross sectional view of the cam operated butt pad locking mechanism showing the butt pad clamping member, upper adjustment rail of the butt pad assembly, and a double-acting cam lever assembly in an open and loosened non-locking release position.
Figure 9B:
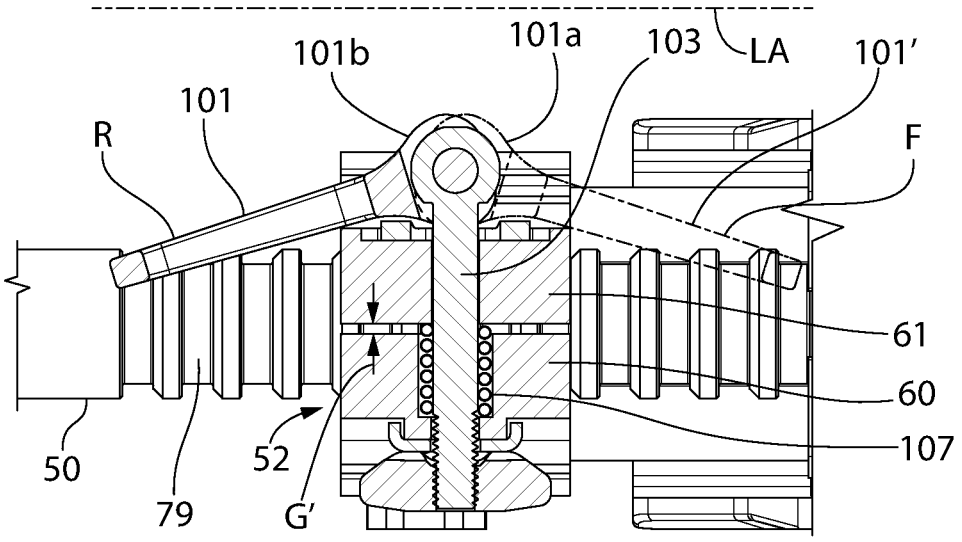
FIG. 9B is a cross sectional view thereof showing the cam lever assembly in two alternate closed and tightened locking positions.

Operation of the cam lever assembly 100 will now be briefly described with initial reference to FIGS. 9A and 9B. These figures show top cross-sectional views of the cam lever assembly and the clamping member 52 engagement with the upper adjustment rail 50. The double-acting cam lever 101 is pivotably movable from an open center neutral or release position in which the cam lever assembly is loosened, to one of two diametrically opposed closed side locking positions in which the cam lever assembly is tightened. The closed positions may be at least 180 degrees apart and the open position is between the closed positions, preferably midway between the locking positions in one embodiment.

Beginning with FIG. 9A, the cam lever assembly 100 is shown with the cam lever 101 in the opened center loosened or release position. In the present non-limiting embodiment, the center release position of the cam lever 101 is characterized by the operating lever 108 being oriented substantially perpendicular to the longitudinal axis and the right lateral sidewall 59 of clamping member 52 (the term "substantially" recognizing that the lever may be canted slightly to one or other side of center so long as the locking surfaces 110 are not positively engaged with the right jaw to lock the adjustment rails in position). The clamping member 52 is in the unlocked position, in which the upper and lower adjustment rails 50, 51 can slide through the clamping member. The flat release surface 111 of cam head 109 is engaged with the washer 104. Placing the cam lever in this center release position allows the jaws 60, 61 to open and spread fully apart (under the biasing action of spring 107), thereby moving the clamping member 52 to the open unlocked position for adjusting the length of the buttstock. Spring 107 urges the laterally moveable latching piece 78 outwards by the maximum amount permitted and limited by prior adjustment and tightening of the finger nut 106, as described above. Because the cam head flat release surface 111 is closer to the pivot axis of the cam lever 101 defined by pin 102 than either of the two arcuate locking surfaces 110*a*, 110*b*, the distance between the release surface and the bearing surface defined in this example by the washer 104 is the shortest. Therefore, the cam lever 101 is in a slightly loosened condition allowing the biasing spring to laterally displace the locking piece 78 slightly which allows the upper and lower adjustment rails 50, 51 to slide through the clamping member 52. This contrasts to the tightened condition of the cam lever 101 when either of the two locking surfaces engage the washer 104 clamping the jaws 60, 61 against the rails.

The left and right jaws 60, 61 are separated by a gap G sufficient to at least partially or fully disengage the locking protrusions 76, 77 from index grooves 79, 80 of the upper and lower adjustment rails 50, 51 by an amount that allows the user to slide the rails with respect to the clamping member 52. With both the upper and lower adjustment rails 50, 51 released, the butt pad assembly 33 may be pushed forward to shorten the length of the buttstock 30 or pulled rearward to lengthen the buttstock.

In some embodiments to slide the upper adjustment rail 50, the cheek rest cam lever assembly 100 may also need to be unlocked and open to relieve a clamping force on upper adjustment rail 50 imparted by the cheek rest bearing blocks 142, 143 as further described below.

Once the desired length of the buttstock 30 has been reached, the buttstock is ready to be locked into axial position. The user may pivot the cam lever 101 to either one of the two closed front or rear side locking positions shown in FIG. 9B provided by the double-acting cam lever mechanism (side referring to opposite sides of the pivot axis defined by cam lever pivot pin 102). The cam lever in the alternate front locking position is represented by numeral 101' and shown in dashed lines. The front locking position is designated by reference numeral "F" and rear locking position by reference numeral "R." In the front and rear locking positions F and R, the operating handle 108 will either point forward or rearward respectively. In the present non-limiting embodiment, both locking positions of the cam lever 101 are characterized by the operating lever 108 being oriented parallel or obliquely (i.e. inwards beyond the 0 to 180 degree vertical plane defined by the right lateral sidewall 59 of right jaw 61) to the longitudinal axis and the right lateral sidewall 59 of clamping member 52. Cam lever 101 is capable of pivotal movement restricted to less than 360 degrees, and in some preferred embodiments to a maximum of about 270 degrees or less between the front F and rear R locking positions. Accordingly, in this embodiment the cam lever 101 is not completely rotatable a full 360 degrees, but rather limited to pivotal movement.

When the cam lever 101 is rotated to one of the front or rear locking positions F or R, the respective arcuate locking surface 110*a* or 110*b* engages the bearing surface defined by washer 104. This pulls the coupling shaft 104 transversely towards the cam lever 101 and right lateral side 59 of the clamping member 52 against the outward biasing force of spring 107 acting on locking piece 78 and right jaw 61. The opening spring 107 is compressed as the jaws 60, 61 are drawn together into the closed locked position of the clamping member 52. The locking protrusions 76, 77 are in meshed relationship with and lockingly engage the one of the index grooves 79 and 80 on the upper and lower adjustment rails 50, 51 respectively. This fixes the axial position of the buttstock 30. The butt pad assembly 33 is no longer axially movable with respect to the clamping member 52 and secured in the axial position selected. A new gap G' is formed between the jaws 60 and 61 which is smaller than gap G when the clamping member is in the open unlocked position shown in FIG. 9A. The cam lever 101 may be in a position folded inward against the clamping member 52 (see, e.g. FIGS. 10A-C).

In some embodiments with the butt pad assembly position locked in place, the cheek rest cam lever assembly 100 may now be closed and locked.

It should be noted that the locking position of the cam lever 101 selected depends in part on whether the user has adjusted the butt pad assembly 33 to a short or long stock length. The front locking position F will not interfere with the butt pad for a shortened buttstock 30 while the rear locking position R can be used for a lengthened buttstock (see, e.g. FIG. 3). Advantageously, the double-acting cam lever 101 provides a versatile arrangement for securing the buttstock in any of the multiple possible axial positions in contrast to use of a single-acting cam lever as commonly used in prior designs.

Figure 14:
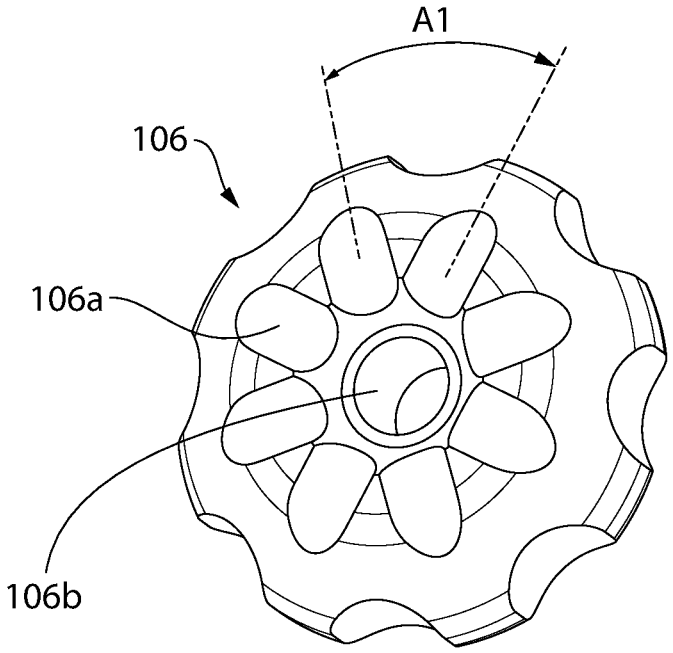
FIG. 14 is a back (inside) perspective view of a finger nut used in the locking mechanisms of the butt pad and cheek rest.
Figure 15A:
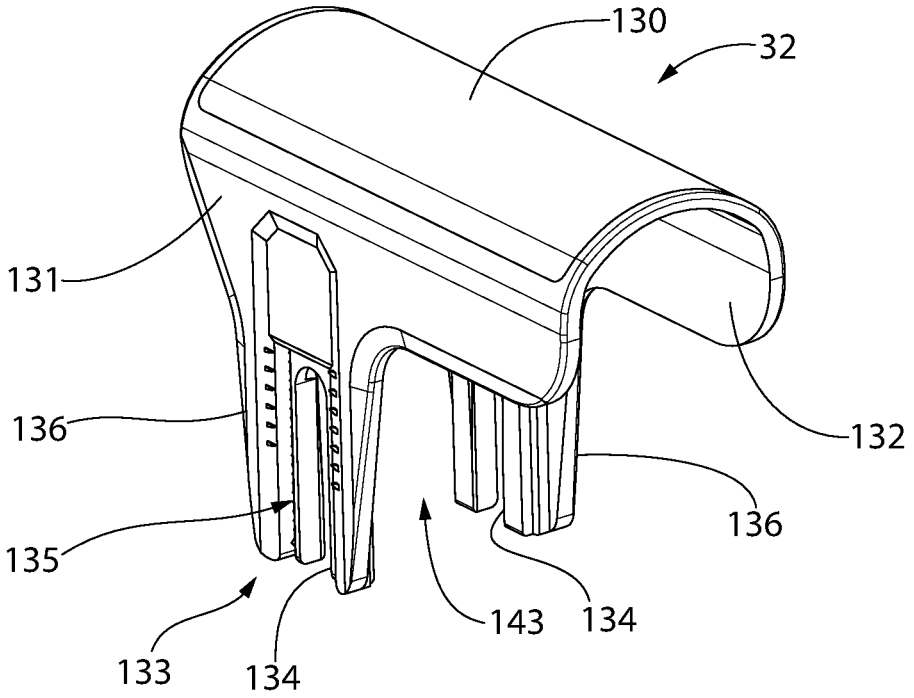
FIGS. 15A and 15B are front and rear perspective views of the cheek rest.
Figure 15B:
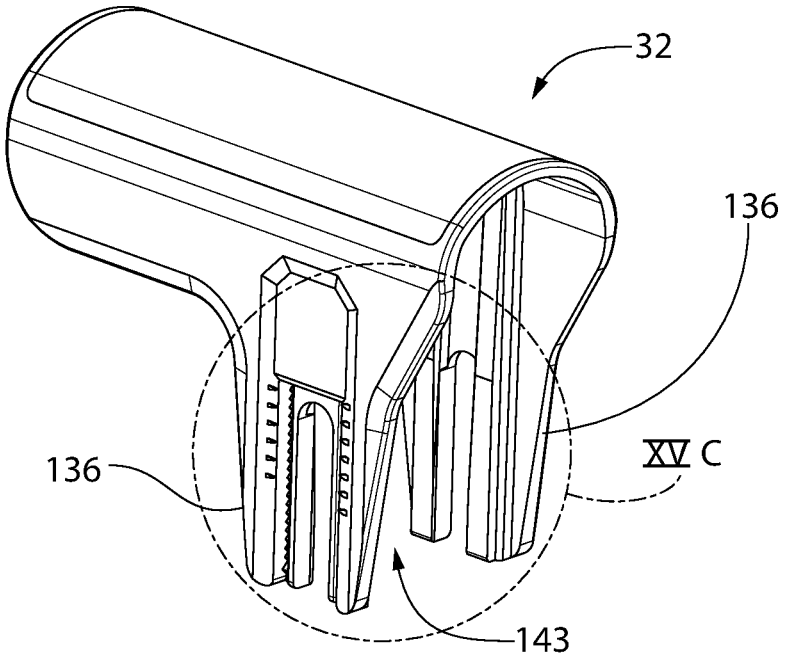
Figure 15C:
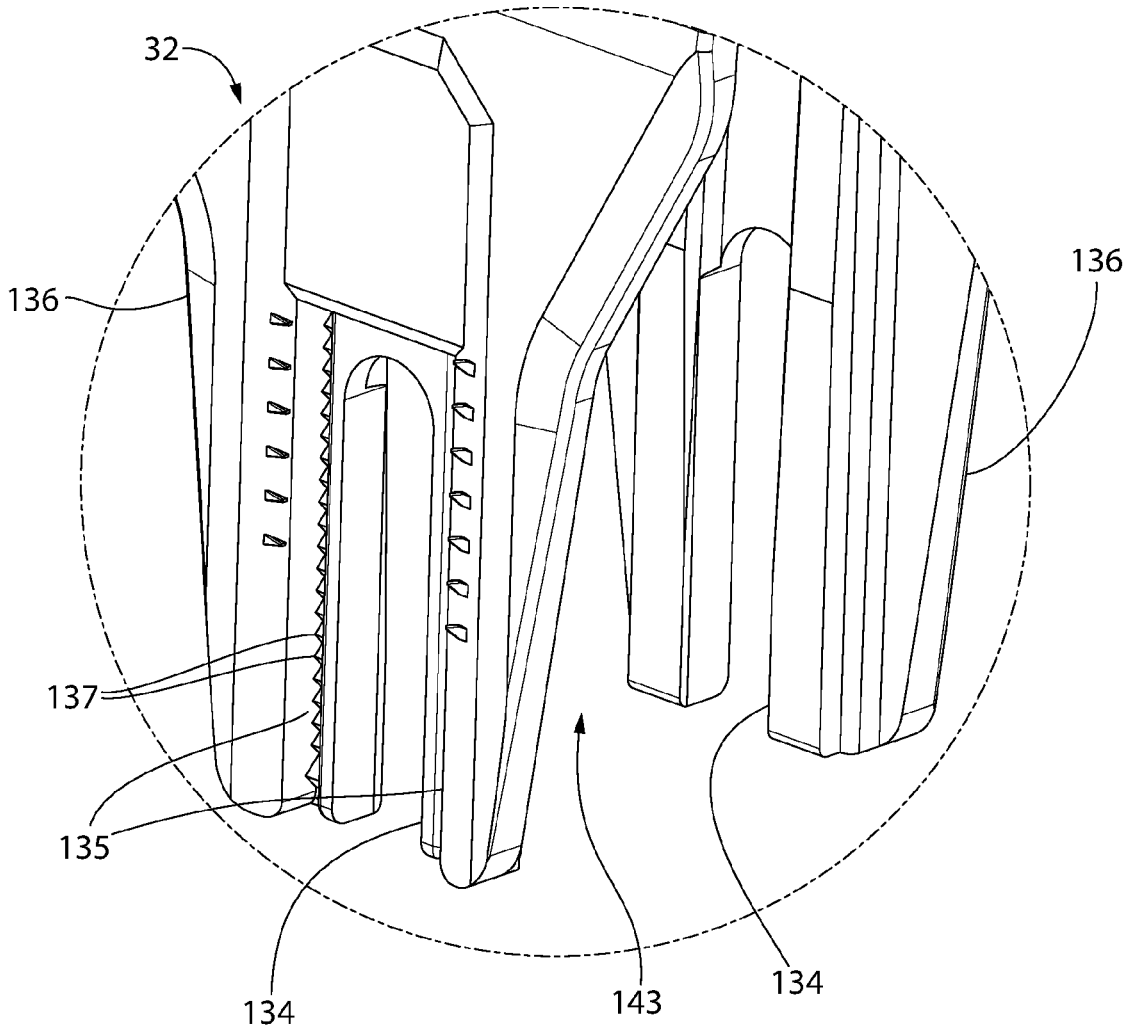
FIG. 15C is an enlarged detail taken from FIG. 15B.

According to another aspect of the invention, an indexed tensioning mechanism is provided for adjusting the tension in the cam lever assembly 100. Finger nut 106 includes a plurality of elongated radially extending recessed detents 106*a* formed on the inward facing side of the nut. Even or odd numbers of detents 106*a* may be provided. In one embodiment, the detents may be arranged in diametrically opposed pairs. Eight detents 106*a* may be provided in one example arrangement shown in FIG. 14. The detents 106*a* radially extend outwards from the threaded central hole 106*b* which is threaded onto the exposed threaded end 103*a* of coupling shaft 103 that defines a rotational axis for finger nut 106.

Figure 13A:
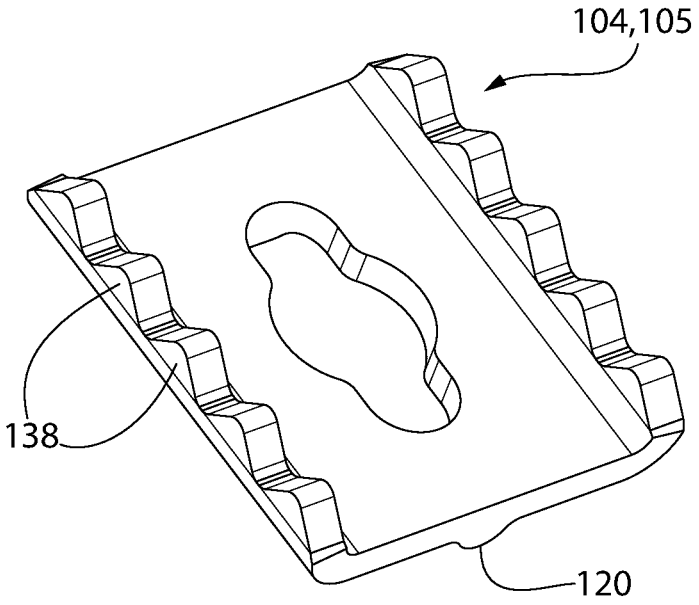
FIGS. 13A and 13B are back (inside) and front (outside) perspective views of a ribbed locking washer used in the locking mechanisms of the butt pad and cheek rest.
Figure 13B:
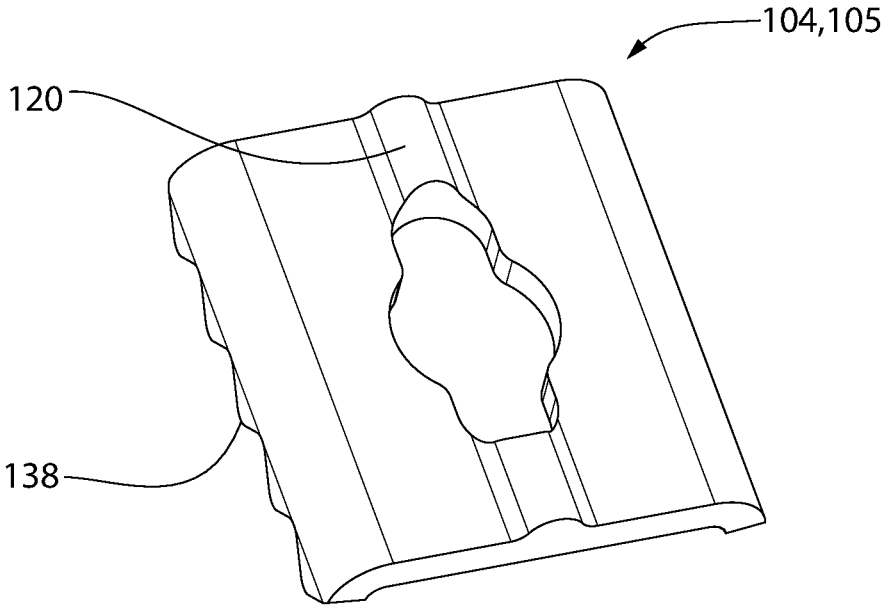

As the finger nut 106 is rotated, detents 106*a* alternatingly mate with and selectively engage a protruding linear index rib 120 disposed on clamping member 52. In one embodiment, rib 120 is conveniently formed on washer 105 (best shown in FIGS. 13A-B). Detents 106*a* are circumferentially spaced apart by angle A1 selected to provide a plurality of circumferential index positions.

In operation, when the cam lever 101 is in one of the two tightened side front or rear closed and locked positions (see, e.g. FIG. 9B), the finger nut 106 is held securely in place from loosening by the engagement between the rib 120 and an engaged diametrically opposed pair of detents 106*a* (one each on top and bottom of through hole 106*b*) which prevents rotation of the nut. The coupling shaft 103 and cam lever 101 assisted by spring 107 apply an inward directed pulling force on the finger nut 106 thereby maintaining positive engagement of the rib 120 in the detents 106*a*. When the cam lever 101 is instead released and pivoted to the opened center release position opened and unlocked (see, e.g. FIG. 9A), the opening spring 107 still holds the washer 105 and finger nut 106 against each other, but clearance is now created sufficient to allow the washer and nut to separate slightly when the nut is turned by the user.

The foregoing indexed detent action is useful for setting the tension in the cam lever assembly 100. If the user closes the cam lever 101 and finds it too loose to operate the jaws 60, 61 of clamping member 52 properly, the cam lever can be positioned in the center release position and the finger nut can be rotated and tightened in ⅛ turn increments (in the present example with eight detents), with a positive detent felt at each increment by the user. The detent action also advantageously creates a "clicking" noise providing not only a tactile sensation, but an audible signal as well each time a circumferential index position is reached. The cam lever 101 can then be easily reclosed, testing the new setting, and the process can be repeated until the desired tension is achieved. This quick and intuitive adjustment method allows a positive and consistent locking force to be maintained in both closed cam lever locking positions as well as over the wide range of adjustment where part tolerance may allow some variation.

The cheek rest 32 adjustment and locking feature will now be described.

Referring initially to FIGS. 2-5, 7, 8, and 10-15 (inclusive of all alphabetic subparts), the cheek rest locking mechanism in one embodiment may include the same double-acting cam lever assembly 100 as previously described for the butt pad locking mechanism. The indexed position elements however are incorporated into components of the cam lever assembly 100 and body of the cheek rest. The tension in the cheek rest cam lever assembly 100 may be accomplished using the same indexed detent action of the finger nut 106 and ribbed washer 105 arrangement described above.

Cheek rest 32 has a generally U-shaped body including an upper main portion forming an arcuately curved top 130 and opposing right and left sidewalls 131 and 132. The main portion is axially elongated in the direction of the longitudinal axis LA. A pair of bifurcated lateral adjustment legs 136 extends downwardly from the sidewalls 131, 132 forming therein a vertical slot 134 have a closed top end and open bottom end. A toothed rack 135 is disposed on each side of the slots 134 forming a pair of horizontally spaced apart toothed racks on each adjustment leg. Each toothed rack 135 comprises a plurality of teeth 137 in a linear or serial arrangement (best shown in FIG. 15C). The toothed racks 135 in each pair are arranged parallel to each other.

In one embodiment, the toothed racks 135 are arranged to engage mating parallel and horizontally spaced apart linear rows or arrays of teeth 138 formed on washers 104 and 105 which act as locking washers. The toothed racks 135 formed on the cheek rest 32 are movable upwards and downwards along the rows of teeth 138 on the washers into a plurality of indexed positions formed by meshed teeth. Washers 104 and 105 for this application preferably have a rectilinear shape and include linear index rib 120 for providing indexed detent operation of the finger nut 106 described above for adjusting the tension in cam lever assembly 100.

In other embodiments contemplated, it bears noting than only one of the washers 104 or 105 may have teeth 138 and the other washer may be toothless. Accordingly, only one of the adjustment legs 136 of the cheek rest 32 will provide the desired indexing type adjustment of the cheek rest 32 and maintenance of the adjusted position which is an operable arrangement. In some embodiments, the washer 104 or 105 without the teeth may alternatively be omitted entirely.

It bears noting that although these toothed locking type washers 104, 105 may be used with the butt pad cam operated locking mechanism as shown and described herein for convenience and to reduce the number of different parts for the assembly, plain washers of a suitable rectilinear or non-rectilinear shape may alternatively be used for the butt pad. For the butt pad locking mechanism, the indexed movement and locking features do not rely on the washer and are provided by other elements.

Cheek rest 32 is adjustable into a plurality of vertical positions with respect to the buffer tube 31 of the buttstock assembly. The cam lever assembly 100 operates in the same manner as described for the butt pad. Cam lever 101 has a center release position and two opposing top and bottom locking positions because the lever is oriented vertically for the cheek rest adjustment in lieu of horizontally as used for the butt pad adjustment. The top position is designated by reference number "T" in FIG. 10B and the bottom position is designated by reference numeral "B" in FIG. 10A. Lever 101 is therefore pivotally movable upward or downwards between the two locked positions for cheek rest 32 adjustment.

Figure 11A:
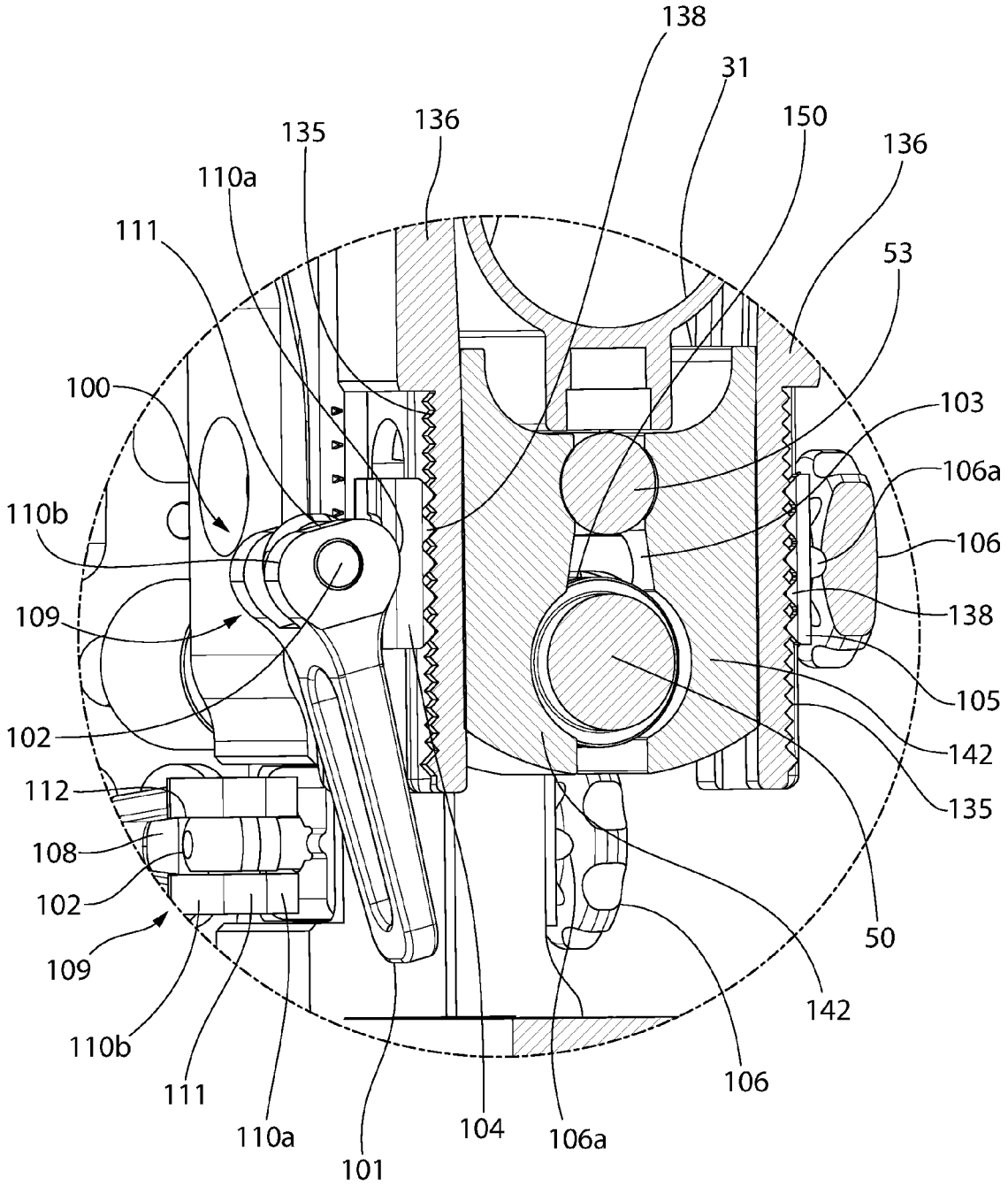
FIG. 11A is a partial cross sectional perspective view looking rearward taken through the cam operated cheek rest locking mechanism of the cheek rest.
Figure 11B:
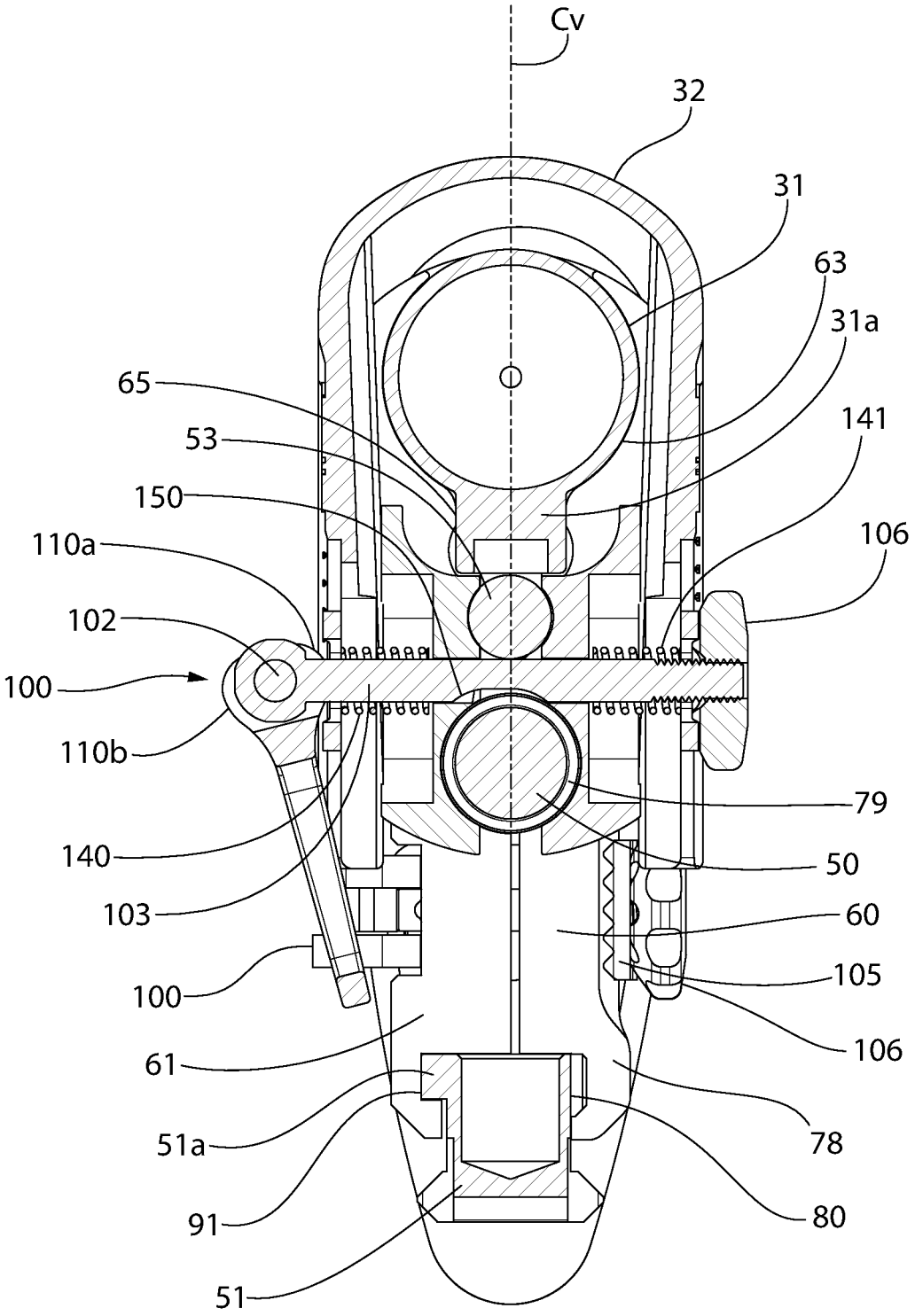
FIG. 11B is a front cross sectional view looking rearward thereof.

The cheek rest adjustment and locking feature further includes right and left bearing blocks 142 which may be identical in configuration, but reversed in orientation providing a mirror image of each other when mounted in the cheek rest (see, e.g. FIGS. 11A-B). Bearing blocks 142 include a laterally open through hole through which the coupling shaft 103 extends. The bearing blocks 142 are disposed inside the cheek rest adjustment legs 136 in the axially open interior space 143 formed between of the legs through which the upper adjustment rail 50 and stabilizing rod 53 extend longitudinally. The bearing blocks 142 each include an upper and lower axially oriented channel 143, 144 having a diameter and transverse profile complementary configured to the rail 50 and rod 53. The channels are arcuately shaped in transverse profile and form semi-circles so that a complete circle is circumscribed when both bearing blocks are combined.

The cheek rest 32 is supported by and mounted to the upper adjustment rail 50, and in some embodiments where provided further to the stabilizing rod 53 both of which pass axially through the bearing blocks 142. The bearing blocks clamp the upper adjustment rail and stabilizing rod providing two points of support which resist transverse twisting of the cheek rest with respect to the longitudinal axis LA. The cheek rest 32 may further be adjustable in axial position on the upper adjustment rail 50 to allow the user to select different axial positions for the cheek rest on the buttstock 30.

The upper adjustment rail 50 is slidably but not lockingly received through lower channel 144 of the cheek rest 32. However, the clamping force from the cheek rest cam assembly 100 acting on upper adjustment rail 50 may still create enough friction to prevent adjustment of the length of pull of the buttstock 30 when the cheek rest cam lever 101 is closed and locked. Accordingly, in the present embodiment, both the butt pad and cheek rest cam assemblies 100 need to be unlocked in order to adjust the length of the buttstock. The benefit is that upper adjustment rail 50 is also effectively clamped to stabilizing rod 53 by the cheek rest 32 to better support the butt pad assembly. The cheek rest 32 remains in contact with the teeth in the washers so that it does not just drop freely when the cheek rest cam assembly is opened and unlocked, thereby still maintaining the height adjustment of the cheek rest.

Two springs 140, 141 are located on the right and left respectively of the bearing blocks 142 in the cheek rest cam lever assembly 100. This provides tension for proper functioning of the cam lever 101 and biases the bearing blocks 142 inwards towards each other and engagement with the upper adjustment rail 50 and stabilizing rod 53. One end of spring 140 acts on the inward facing surface of washer 104 and the other end acts on the outward facing surface of the right bearing block 142. Similarly, one end of spring 141 acts on the inward facing surface of washer 105 and the other end acts on the outward facing surface of the left bearing block 142 (best shown in FIG. 11B).

In operation, when the cam lever 101 is in the opened center release position, the cheek rest 32 may be slid up or down in vertical position relative to the buffer tube 31. The toothed racks 135 on each of the right and left adjustment legs 136 engage and slip over the rows of teeth 138 on washers 104 and 105 (which remain stationary in vertical position with the cam lever 101 and related components). The force imparted by the springs 140, 141 on washers 104, 105 create a ratcheting action with accompanying audible "click" and a tactile sensation each time the cheek rest is incrementally raised or lowered in an indexed manner.

Figure 10A:
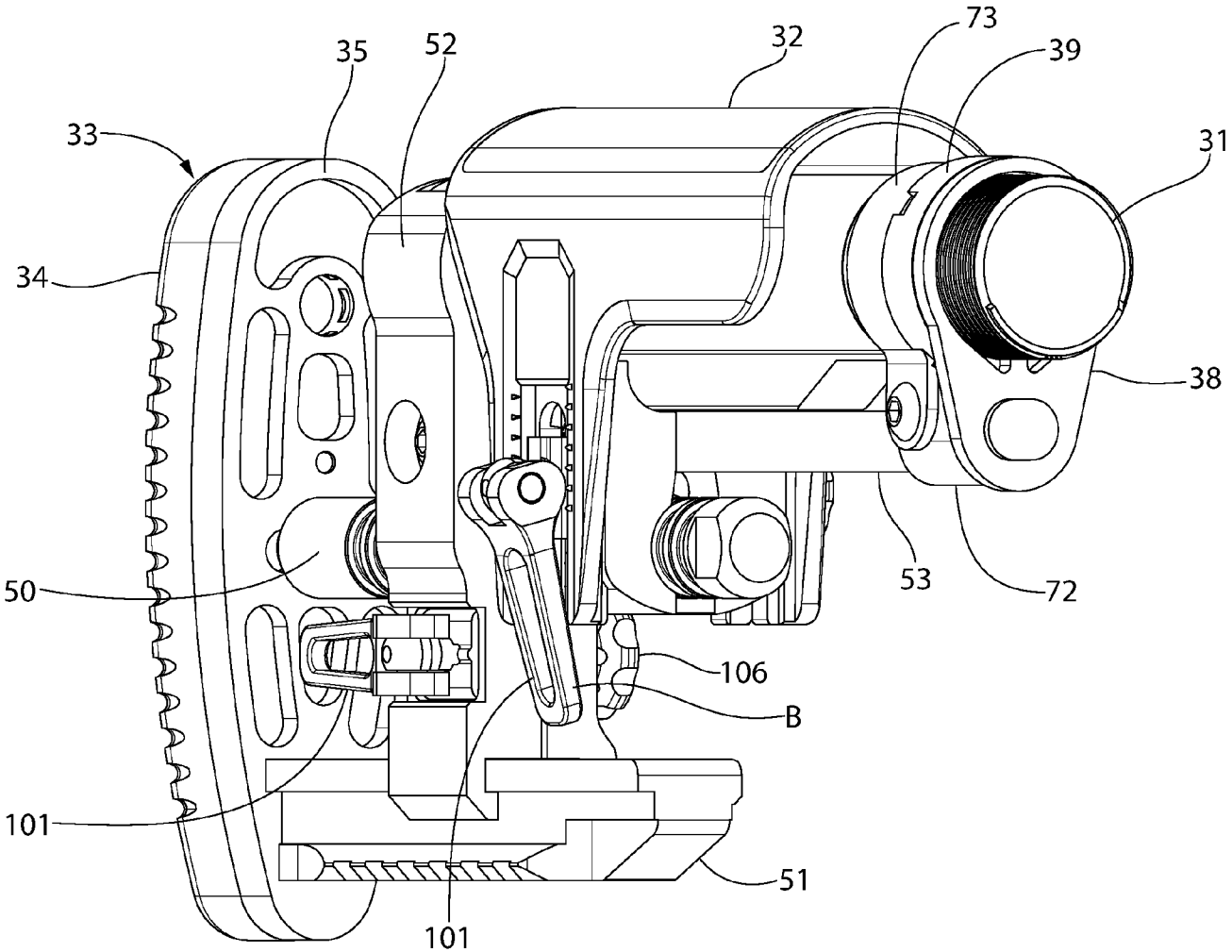
FIG. 10A is a front right perspective view of the buttstock.

When the desired cheek rest position is reached, the cam lever 101 is folded up or down against the cheek rest 32 into either of the two closed top or bottom locked positions to lock the cheek rest in position. FIG. 10A shows the cheek rest 32 in one possible lower adjustment position and the cam lever 101 folded downwards in a locked position. The cheek rest 32 may be positioned downwards against the buffer tube 31 in its lowest adjustment position so that the buffer tube is nested inside the arcuately shaped top 130 of the cheek rest. Accordingly, the curvature of the top of cheek rest 32 may be selected to complement the diameter and curvature of the buffer tube to form this nested relationship.

Figure 10B:
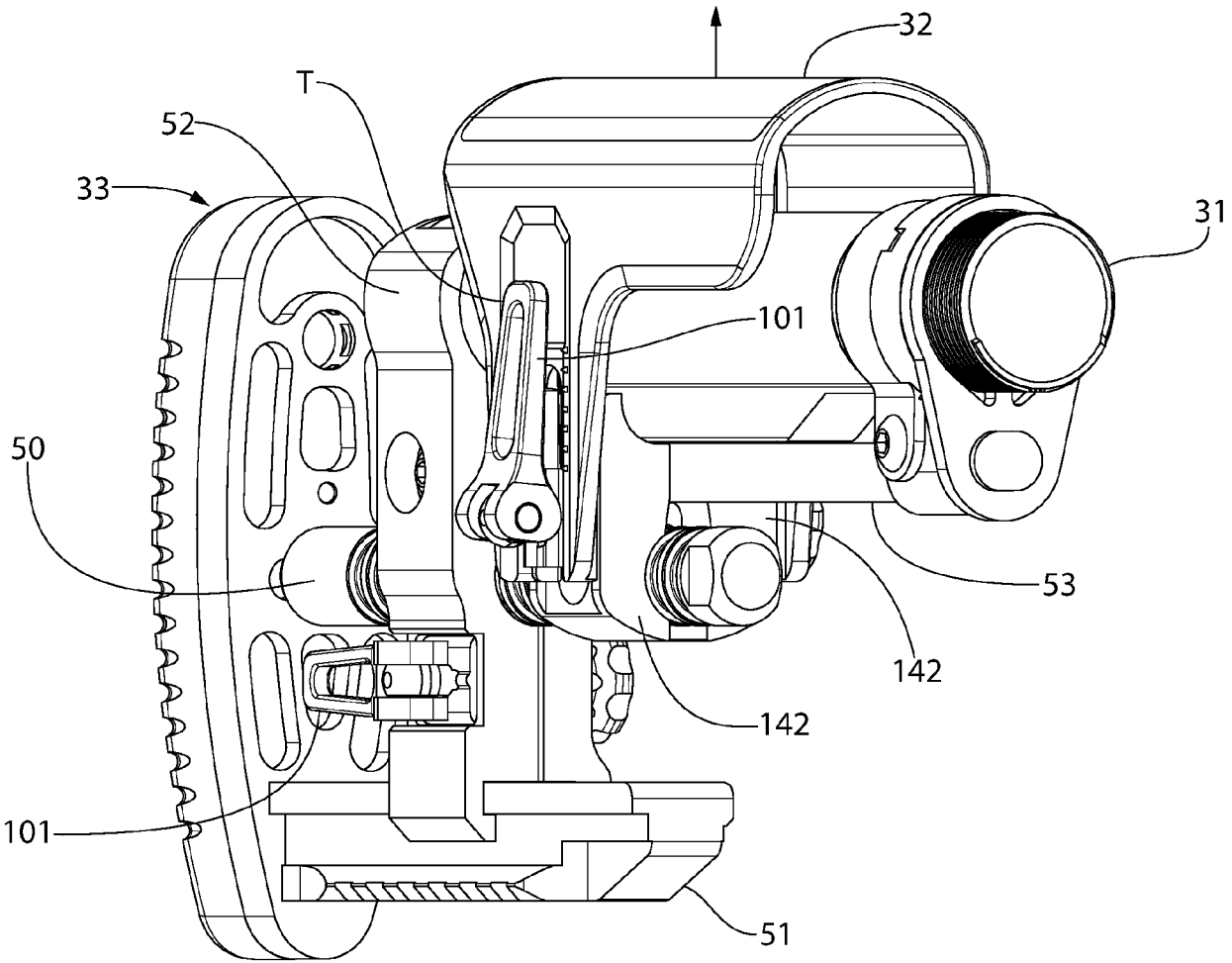
FIG. 10B is a front right perspective view thereof showing the cheek rest in a raised position.
Figure 10C:
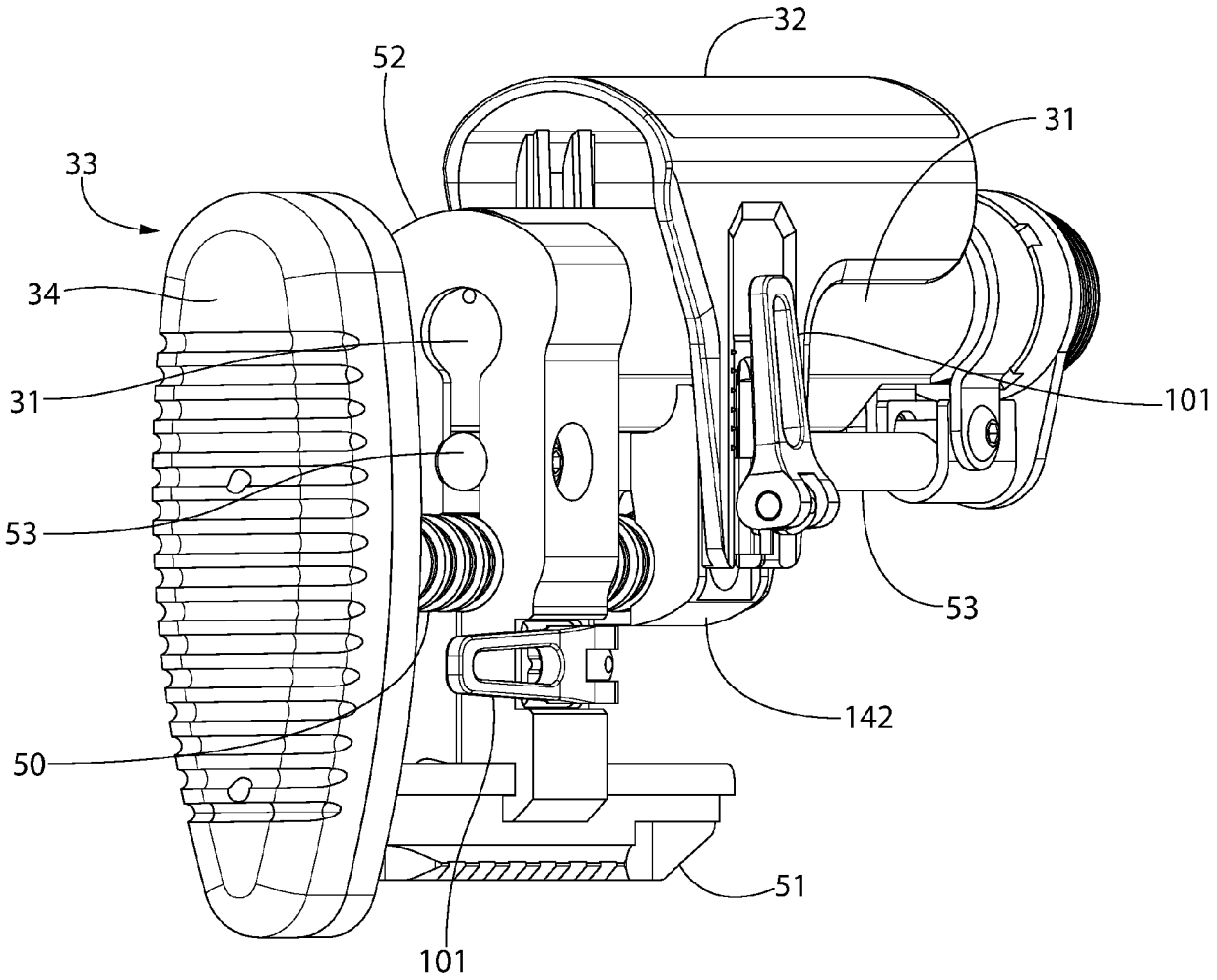
FIG. 10C is a rear right perspective view thereof.
Figure 10D:
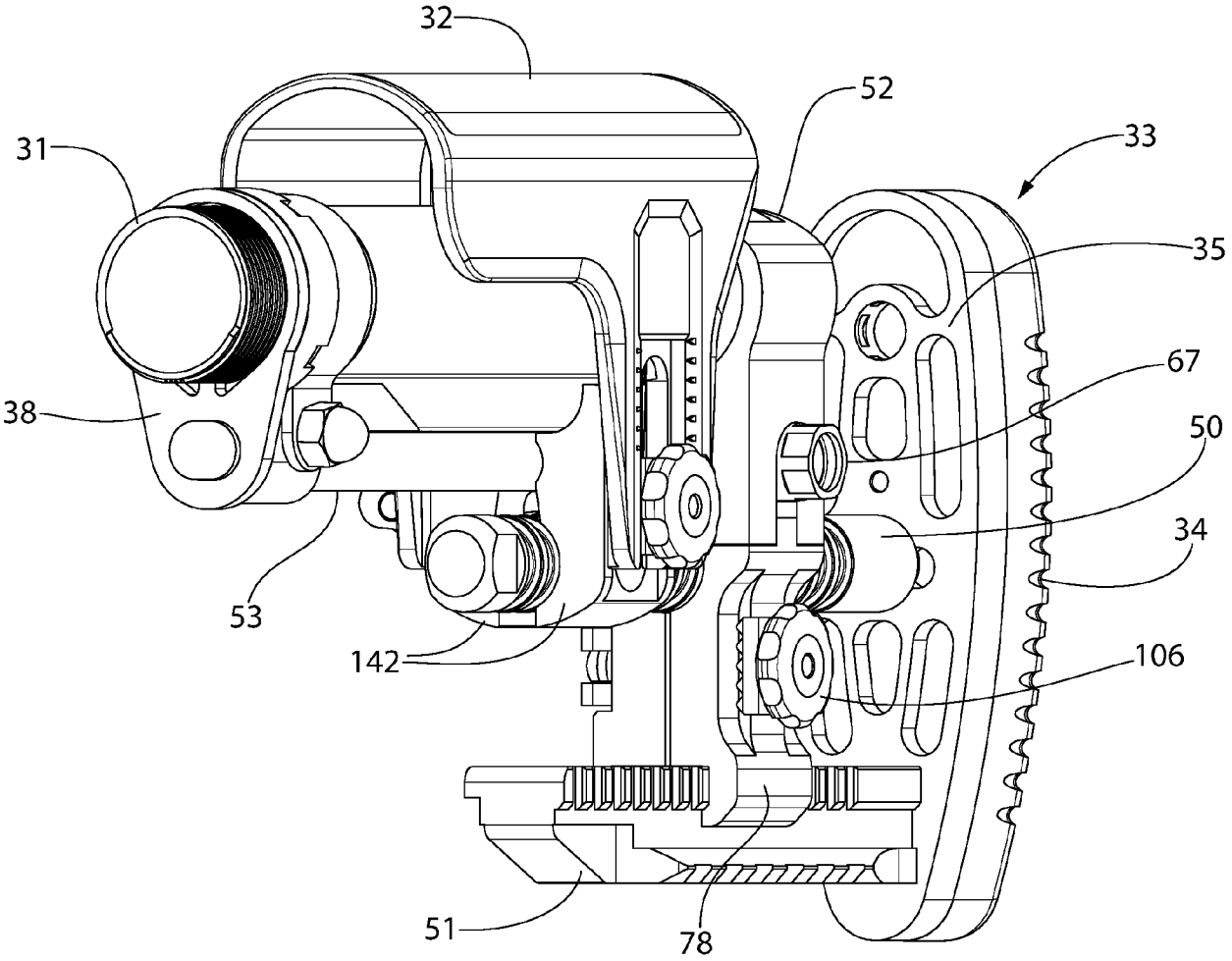
FIG. 10D is a front left perspective view thereof.
Figure 10E:
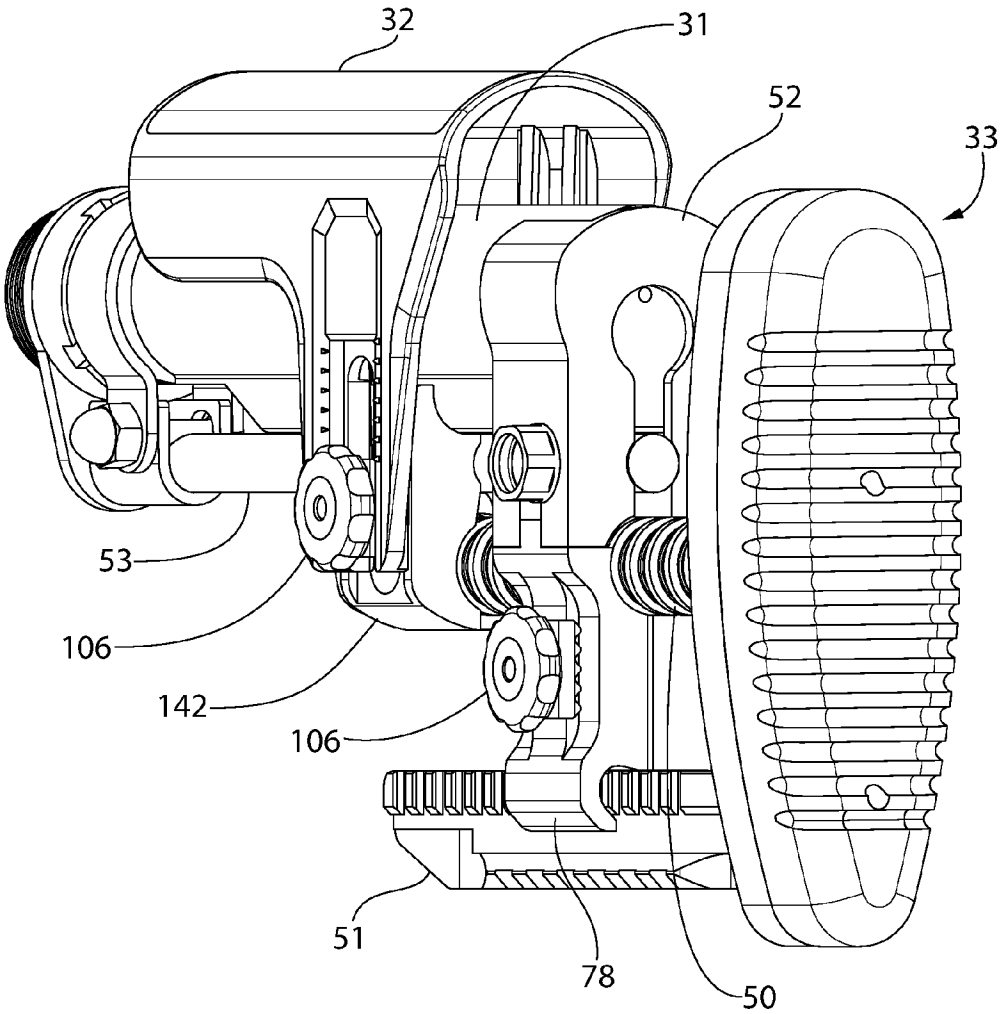
FIG. 10E is a rear left perspective view thereof.

FIG. 10B shows the cheek rest 32 in one possible upper adjustment position for comparison higher than in FIG. 10A, and the cam lever 101 folded upwards in a locked position. It should be noted that the cheek rest cam lever 101 may have alternatively been folded upwards or downward into either the top or bottom locked positions of the lever in FIGS. 10A and 10B. When the cheek rest cam lever 101 is in the top locked position shown in FIG. 10B, it can be appreciated that the rear butt pad cam lever 101 may have alternatively been folded forward into the front locked position instead of rear as shown if a short buttstock adjustment length were selected. In this configuration, the cheek rest cam lever would not interfere with the butt pad cam lever front locked position. Accordingly, versatile possible cam lever positions are beneficially provided by the present design. FIGS. 10C-E show other views of the cheek rest in the upper adjustment position shown in FIG. 10B.

In some embodiments, the cam lever assembly associated with the cheek rest 32 may be configured to provide an additional secondary and optional locking feature for the butt pad assembly 33 by selectively preventing sliding movement of the upper adjustment rail 50 through the cheek rest. Referring to FIGS. 8 and 11A-B, the coupling shaft 103 extends transversely between stabilizing rod 53 and the upper adjustment rail 50 below. Coupling shaft 103 of the cheek rest cam lever assembly 100 includes an outwardly open arcuate cutout 150 which is selectively movable into and out of concert with the upper adjustment rail 50. The coupling shaft 103 is configured and dimensioned to extend partially below the outermost surface of the upper adjustment rail 50 into one of the index grooves 79 on the rail which happens to be laterally aligned with the shaft. The cutout effectively reduces the diameter of the coupling shaft in that portion to avoid engagement of coupling shaft 103 with the upper adjustment rail 50 when moved in orientation to face and be located proximate and adjacent to the upper adjustment rail 50.

The rotational orientation cheek rest cam lever 101 controls the lateral/transverse position of the cutout 150 on the coupling shaft 103 with respect to the upper adjustment rail 50. Coupling shaft 103 is rotatable when the cam lever 101 is in the opened and loosened center release position. When the cutout 150 faces the upper adjustment rail 50 and is located immediately adjacent to the rail as shown in FIGS. 11A-B, the rail can slide through the cheek rest 32 regardless of whether the cheek rest cam lever 101 is unlocked (i.e. center release position) or locked (i.e. either of the two side locking positions).

To activate the secondary upper adjustment rail 50 locking feature, the user opens the cam lever 101. Assuming the cam lever 101 is in one of the closed locked positions and the cutout 150 on coupling shaft 103 is first proximate to and facing the upper adjustment rail as shown in FIGS. 11A-b, the user then pivots the lever to the center release position. Next, the user rotates the cam lever 101 by 180 degrees. This concurrently rotates the coupling shaft 103 by an angle of 180 degrees which repositions the cutout 150 on the far side of the coupling shaft distal to and facing away from the upper adjustment rail 50. Because the cutout 150 is no longer in physical proximity to the upper adjustment rail 50, the full diameter profile of the coupling shaft 103 adjacent to cutout now protrudes into and engages the closest index groove 79 on the upper adjustment rail. The full diameter portion of the coupling shaft diametrically opposite to the cutout now extends through and downwards into the index groove 79 on the upper adjustment rail to lockingly engage the rail. This full diameter portion of the coupling shaft therefore defines a blocking surface on the coupling shaft 103 which prevents sliding movement of the upper adjustment rail 50 so that the butt pad assembly 33 is locked in axial position by the coupling shaft. This provides a secondary locking feature for the butt pad in addition to the primary locking feature of the locking piece 78 on the left jaw 61. Moving the cam lever 101 from either the open unlocked center release position to either of the two closed locking positions does not disengage the coupling shaft from the upper adjustment rail index groove 79.

Accordingly, the coupling shaft 103 of the cheek rest cam lever assembly 100 is rotatable between a blocking position in which the shaft engages an index groove 79 on the upper adjustment rail 50 and a non-blocking position in which index groove 79 and rail are disengages from the coupling shaft with the cutout 150 positioned proximate to and facing the upper adjustment rail. The cutout 150 of the coupling shaft 103 is therefore rotatable between a distal position and a proximate position with respect to the upper adjustment rail 50. To ensure the coupling shaft 103 disengages the upper adjustment rail 50 regardless of whether the cheek rest cam lever 101 is in the open/unlocked or closed/locked position, cutout 150 is preferably located in proximate vertical alignment with the center of the upper adjustment rail which may lie on the vertical centerline Cv of the buttstock 30 in some embodiments (see, e.g. FIGS. 11A-B).

If the butt pad is to be moved for adjusting the length of the buttstock 30 when the coupling shaft 103 of the cheek rest cam lever assembly 100 is in the blocking position, the coupling shaft must be first be rotated to the non-blocking position if the user intends the cheek rest to remain in the same axial position on the buttstock. Otherwise, pulling or pushing the butt pad assembly 33 rearward or forward will move the cheek rest with the butt pad due to the interlock between the coupling shaft and upper adjustment rail 50 when the shaft is in the blocking position.

It should be noted that although the cam levers 101 of the butt pad and cheek rest cam lever assemblies 100 are shown located on the right lateral side of the buttstock, in other embodiments one or both of the assemblies may be reversed instead and mounted on the other left side of buttstock. Accordingly, the invention is not limited by a right or left mounting location for the cam lever assemblies.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. An adjustable buttstock for a firearm, the buttstock comprising:

a longitudinal axis;

an elongated stock mounting extension member configured to mount to the firearm;

a clamping member disposed on the mounting extension member, the clamping member having downwardly extending and opposing first and second jaws;

a butt pad assembly comprising an elongated butt pad and a first adjustment rail protruding axially forward from the butt pad, the first adjustment rail received between the jaws and slidable between a plurality of indexed axial positions for adjusting the length of the buttstock;

the jaws of the clamping member laterally movable together and apart between a locked position lockingly engaging the first adjustment rail in one of the axial positions and an unlocked position partially disengaging the first adjustment rail which allows the rail to slide axially relative to the jaws between the axial positions;

an opening spring biasing the jaws apart;

a double-acting cam lever assembly mechanically coupled to the first and second jaws, the cam lever assembly comprising a cam lever pivotably mounted on the first jaw and including two opposing locking surfaces selectively rotatable into engagement with a bearing surface on the first jaw and a non-locking release surface disposed therebetween;

the cam lever pivotably movable from a center release position to one of two opposing locking positions;

wherein placing the cam lever in the center release position positions the release surface towards the bearing surface on the first jaw and moves the jaws apart to the unlocked position for adjusting the length of the buttstock;

wherein moving the cam lever from the center release position to either of the two locking positions engages one of the locking surfaces with the bearing surface on the first jaw and draws the jaws together to the locked position for fixing the length of the buttstock.

2. The buttstock according to claim 1, wherein the locking surfaces are arcuately shaped and the release surface is flat.

3. The buttstock according to claim 2, wherein the bearing surface is formed on a washer coupled to the first jaw.

4. The buttstock according to claim 1, wherein the cam lever assembly further comprises a transversely movable coupling shaft extending laterally between the first and second jaws, the coupling shaft operably coupling the cam lever to the second jaw for moving the jaws together or apart via pivoting the cam lever.

5. The buttstock according to claim 4, wherein the first and second jaws are both molded or cast as an integral unitary structural part of the clamping member.

6. The buttstock according to claim 5, wherein the second jaw clamping member includes a non-detachable upper portion and a detachable lower locking piece movably coupled to the upper portion, the locking piece connected to the coupling shaft and movable towards and away from the first jaw independently of the upper portion.

7. The buttstock according to claim 6, wherein the locking piece includes a first locking protrusion and the first adjustment rail includes a plurality of longitudinally arranged index grooves, the locking protrusions selectively lockingly engage one of the index grooves on the first adjustment rail when the jaws are in the locked position.

8. The buttstock according to claim 1, further comprising a longitudinally-extending stabilizing rod having a front end attachable to the firearm and a rear end coupled to the butt pad assembly.

9. The buttstock according to claim 1, wherein the stabilizing rod and mounting extension member are received in complementary configured sockets formed in the clamping member.

10. The buttstock assembly according to claim 9, further comprising a threaded cross bolt extending laterally between the first and second jaws, the cross bolt being tightened to apply a compressive clamping force on the mounting extension member and stabilizing rod for securement to the clamping member.

11. The buttstock according to claim 10, wherein the cross bolt extends through a transverse hole in the stabilizing rod to lock the stabilizing rod to the clamping member.

12. The buttstock according to claim 4, wherein tension in the cam lever assembly is adjusted by rotating a finger nut disposed on an end of the coupling shaft at the second jaw, the finger nut including a plurality of radially extending detents which alternatingly engage a raised rib formed on a washer disposed on the second jaw.

13. The buttstock according to claim 1, further comprising:

a cheek rest movably coupled to the upper adjustment rail, the cheek rest adjustable in height with respect to the mounting extension member, the cheek rest including first and second adjustment legs extending downwards from opposing lateral sides of an arcuately curved top of the cheek rest;

a pair of vertically extending toothed racks formed on each adjustment leg;

a first toothed washer arranged on the first adjustment leg, the first washer comprising a first row of teeth and a second row of teeth engaging the pair of toothed racks on the first adjustment leg;

a first spring biasing the first toothed washer outwards for disengaging the toothed racks on the first adjustment leg from the first and second rows of teeth on the first washer;

a double-acting second cam lever assembly mechanically coupled to the first and second adjustment legs, the second cam lever assembly comprising a second cam lever mounted on the first adjustment leg, the second cam lever including an elongated operating handle and a cam head comprising two opposing locking surfaces and a non-locking release surface disposed therebetween;

the second cam lever pivotably movable from a center release position to one of two opposite locking positions;

wherein placing the second cam lever in the center release position disengages the first and second rows of teeth on the first washer from the toothed racks on the first adjustment leg to enable the height of the cheek rest to be adjusted;

wherein moving the second cam lever from the center release position to either of the two opposite locking positions engages the first and second rows of teeth on the first washer with the toothed racks on the first adjustment leg to fix the height of the cheek rest.

14. The buttstock according to claim 13, wherein the first adjustment rail extends longitudinally between opposing first and second bearing blocks disposed inside the cheek rest, the first bearing block biased into engagement with the first adjustment rail by the first spring, and the second bearing block biased into engagement with the first adjustment rail by a second spring.

15. The buttstock according to claim 14, wherein the second cam lever assembly further comprises a transversely movable coupling shaft extending laterally between the first and second adjustment legs, the coupling shaft operably coupling the cam lever to the second adjustment leg for moving the adjustment legs together or apart via pivoting the cam lever.

16. The buttstock according to claim 15, wherein tension in the second cam lever assembly is adjusted by rotating a finger nut disposed on an end of the coupling shaft at the second adjustment leg, the finger nut including a plurality of radially extending detents which alternatingly engage a raised rib formed on the second washer.

17. An adjustable buttstock for a firearm, the buttstock comprising:

a longitudinal axis;

an elongated mounting extension member configured to mount to the firearm;

a clamping member disposed on the mounting extension member, the clamping member having downwardly extending and opposing first and second jaws;

a butt pad assembly comprising a butt pad;

an upper adjustment rail protruding axially forward from the butt pad assembly;

a lower adjustment rail protruding axially forward from the butt pad assembly;

the upper and lower adjustment rails received between the jaws and slidable between a plurality of indexed axial positions for adjusting the length of the buttstock;

a plurality of longitudinally spaced apart index grooves disposed on the upper or lower adjustment rail;

a double-acting cam lever pivotably mounted on the first jaw, the cam lever comprising an elongated operating handle extending from an adjoining cam head engaging a bearing surface formed on the first jaw;

a coupling shaft extending laterally through the clamping member, the coupling shaft coupled between the cam lever and a movable locking piece of the second jaw, the locking piece including a first locking protrusion selectively engageable with the index grooves;

the locking piece laterally movable inwards and outwards with respect to the first jaw between a locked position locking the adjustment rails in one of the axial positions and an unlocked position allowing the adjustment rails to slide axially relative to the jaws between the axial positions;

the cam lever pivotably movable from a center release position to one of two opposite locking positions on either side of the center release position;

wherein placing the cam lever in the center release position moves the locking piece outward to the unlocked position in which the first locking protrusion at least partially disengages the index grooves for adjusting the length of the buttstock; and wherein moving the cam lever from the center release position to either of the two side locking positions draws the locking piece inward to the locked position in which the first locking protrusion engages the index grooves for fixing the length of the buttstock.

18. The buttstock according to claim 17, wherein both the upper and lower adjustment rails include a plurality of longitudinally spaced apart index grooves, the locking piece including a second locking protrusion, the first and second locking protrusions selectively engageable with the index grooves on the upper adjustment rail and lower adjustment rail.

19. An adjustable buttstock for a firearm, the buttstock comprising:

a longitudinal axis;

an elongated mounting extension member configured to mount to the firearm;

a clamping member fixedly attached to the mounting extension member, the clamping member having downwardly extending first and second jaws;

a butt pad assembly movably coupled to the clamping member, the butt pad assembly comprising parallel longitudinally-extending upper and lower adjustment rails, the upper and lower adjustment rails each received between the jaws and slidable between a plurality of indexed axial positions comprised of longitudinally spaced apart grooves on the adjustment rails for adjusting the length of the buttstock;

the second jaw including an upper portion formed integrally with the first jaw and a removable lower locking piece comprising locking protrusions selectively engageable with the grooves of the upper and lower adjustment rails, the locking piece slidable laterally inwards and outwards with respect to the upper portion of the second jaw between a locked position lockingly engaging the adjustment rails in one of the indexed axial positions and an unlocked position partially disengaging the adjustment rails to allow the rails to slide axially relative to the jaws between the axial positions;

a double-acting first cam lever mechanically coupled to the first jaw and locking piece of the second jaw, the first cam lever pivotably movable between two opposing locking positions located at least 180 degrees apart and a center release position therebetween, the first cam lever operable to selectively move the locking piece between the unlocked and locked positions by pivoting the cam lever respectively from the release position to either of the locking positions;

a cheek rest coupled to the upper adjustment rail, the cheek rest adjustable in height with respect to the mounting extension member, the cheek rest including first and second adjustment legs extending downwards from opposing lateral sides of an arcuately curved top of the cheek rest;

the first adjustment leg including a pair of vertically extending toothed racks;

a first toothed washer comprising dual linear arrays of teeth engageable with the toothed racks on the first adjustment leg;

a first spring biasing the first toothed washer outwards for disengaging the toothed racks on the first adjustment leg from the arrays of teeth on the first washer;

a double-acting second cam lever mechanically coupled to the first and second adjustment legs, the second cam lever pivotably movable between two opposing locking positions located at least 180 degrees apart and a center release position therebetween;

the second cam lever operable to selectively move the cheek rest between (i) a locked position in which the linear arrays of teeth on the first toothed washer engages the toothed racks on the first adjustment leg to lock the cheek rest in position, and (ii) an unlocked position in which the linear arrays of teeth on the first toothed washer at least partially disengage the toothed racks on the first adjustment leg to allow sliding adjustment of the height of the cheek rest.

20. The buttstock according to claim 19, wherein:

the first cam lever is pivotably connected to a laterally movable first coupling shaft that mechanically couples the first jaw to locking piece of the second jaw; and the second cam lever is pivotably connected to a laterally movable second coupling shaft that mechanically couples the first adjustment leg to the second adjustment leg.

21. The buttstock according to claim 20, wherein the second coupling shaft includes an arcuate cutout which is selectively movable between a distal position and a proximate position with respect to the upper adjustment rail; wherein the upper adjustment rail is slidable through the cheek rest when the cutout is proximate to the upper adjustment rail; and wherein the upper adjustment rail is not slidable and fixed in position with respect to the cheek rest when the cutout is distal to the upper adjustment rail.

22. The buttstock according to claim 19, wherein the locking piece comprises a key which slidably engages a keyway in the upper portion of the left jaw for guided lateral movement.

23. The buttstock according to claim 19, further comprising a longitudinally-extending stabilizing rod having a front end attachable to the firearm and a rear end coupled to the butt pad assembly.

24. The buttstock according to claim 19, wherein the cheek rest includes an opposing pair of bearing blocks coupled to the adjustment legs that engage opposite sides of the upper adjustment rail.

25. The buttstock according to claim 24, wherein the first spring and a second springs bias the bearing blocks into engagement with upper adjustment rail.

26. The buttstock according to claim 19, wherein the cheek rest is movable on the upper adjustment rail to different axial positions.

* * * * *